US005490760A

United States Patent [19]

Kotzur

[11] Patent Number: 5,490,760

[45] Date of Patent: Feb. 13, 1996

[54] MULTISHAFT GEARED MULTISHAFT TURBOCOMPRESSOR WITH RETURN CHANNEL STAGES AND RADIAL EXPANER

[75] Inventor: Joachim Kotzur, Oberhausen, Germany

[73] Assignee: Man Gutehoffnungshütte AG, Oberhausen, Germany

[21] Appl. No.: 138,404

[22] Filed: Oct. 14, 1993

[30] Foreign Application Priority Data

Oct. 15, 1992 [DE] Germany ..... 42 34 739.4

[51] Int. Cl.[6] ..... F04D 17/12

[52] U.S. Cl. ..... 415/68; 415/66; 415/115; 415/172.1; 415/174.5

[58] Field of Search ..... 415/60, 62, 66, 415/68, 112, 115, 171.1, 172.1, 174.3, 174.5

[56] References Cited

U.S. PATENT DOCUMENTS

| | | | |
|---|---|---|---|
| 3,001,692 | 9/1961 | Schierl | 415/122.1 |
| 3,861,820 | 1/1975 | Hornschuch | 415/64 |
| 3,941,506 | 3/1976 | Robb | 416/244 A |
| 4,219,306 | 8/1990 | Fujino et al. | 415/62 |
| 4,938,661 | 7/1990 | Kobayashi et al. | 415/199.1 |
| 5,154,571 | 10/1992 | Prumper | 415/60 |
| 5,161,943 | 11/1992 | Maier et al. | 415/174.5 |
| 5,190,440 | 3/1993 | Maier et al. | 415/174.5 |
| 5,320,482 | 6/1994 | Palmer et al. | 415/174.3 |
| 5,382,132 | 1/1995 | Mendel | 415/60 |

FOREIGN PATENT DOCUMENTS

| | | | |
|---|---|---|---|
| 974418 | 12/1960 | Germany . | |
| 2603359 | 8/1976 | Germany | 415/122.1 |
| 2518628 | 10/1976 | Germany . | |
| 655357 | 4/1986 | Switzerland | 415/104 |
| 1275120 | 12/1986 | U.S.S.R. | 415/104 |

*Primary Examiner*—F. Daniel Lopez
*Assistant Examiner*—Michael S. Lee
*Attorney, Agent, or Firm*—McGlew and Tuttle

[57] ABSTRACT

A geared multishaft turbocompressor with impellers arranged in series in terms of flow, are attached to two or more pinion shafts (6), which are arranged in parallel to one another and are driven directly via a central gear (5) or indirectly via pinion shafts at the circumference of the central gear (5). A plurality of impellers (8, 8a) are arranged in series, via the interstage diaphram of a disk-type diffuser (9) and of a return ring (10), on at least one pinion shaft end (6) in high-pressure stages following low-pressure stages (first pinion shaft or first and second pinion shafts) after the second or third pinion shaft (6). Reversing the direction of flow, i.e., admission of the gas on the high-pressure side and discharge of the gas on the low-pressure side, as well as with simultaneous reversal of the direction of rotation, a radial expander (turbine) is obtained with the same basic design.

21 Claims, 23 Drawing Sheets

MULTISHAFT GEARED MULTISHAFT TURBOCOMPRESSOR WITH RETURN CHANNEL STAGES AND RADIAL EXPANER

FIELD OF THE INVENTION

The present invention pertains to a multistage geared multishaft turbocompressor with impellers arranged in series in terms of flow, the impellers are attached to two or more pinion shafts, the pinion shafts are arranged in parallel to one another and are driven directly via a central gear or indirectly via pinion shafts on the circumference of the central gear.

The external drive may be, in the known manner, an electric motor, a steam turbine, or a gas turbine.

In the case of indirect drive via the pinion shaft of the drive, the power transmission to the compressor impellers can be performed via the central gear via the pinion shaft of the compressor impeller or the central gear via intermediate gears via the pinion shaft of the compressor impeller.

BACKGROUND OF THE INVENTION

According to the state of the art, e.g., DE-PS 974,418 one compressor impeller is arranged overhung on each pinion shaft on one side or on both sides in the geared multishaft turbocompressors. Connecting pipelines are located between the stages.

The gas enters the impeller axially via the suction housing and is slowed down in the spiral housing. The external diameter of the impellers steadily decreases with increasing compression and consequently with decreasing suction volume flow rate of the compressor stages to maintain optimal volume flow rates, and the speeds of the pinion shafts steadily increase to maintain the circumferential velocity of the impellers necessary for the stage compression ratio in question. The maximum diameter of the central gear, is determined by its maximum circumferential velocity, this leads to steadily decreasing pinion diameters and with it an increase in the number of revolutions and to steadily decreasing numbers of pinion teeth.

When the limit tooth number is reached, it is necessary to insert intermediate gears to further increase the speed. This leads to additional mechanical frictional losses in the gear bearings and gear teeth.

Rotor dynamic problems in terms of vibration stability, etc., may also occur at the high speeds.

The solution described in German Offenlegungsschrift No. DE-OS 25,15,628, involves one pair of impellers arranged on each pinion shaft back to back on one side only on the side of the gear facing away from the drive. However, this leads to impairments rather than to improvements from the viewpoint of rotor dynamics. This is particularly true because the overhanging rotor part is at a great distance from the center of gravity in this arrangement due to the radial suction hole arranged between the gearbox case and the impeller.

An intercooler, which cools the gas approximately to the initial temperature of compression, is normally arranged between the individual compressor stages. As a result, the final temperatures of the individual compressor stages are also correspondingly low, corresponding to the increase in temperature in the stage.

If the process also requires a high final temperature, the final stage must operate at a correspondingly high circumferential velocity to reach the final temperature required. This causes a further increase in the speed of the pinion shaft, as a result of which the above-mentioned problems are further exacerbated.

A way out to avoid the high circumferential velocity would be to increase the pressure number of the stage, e.g., by setting steeper impeller discharge angles, but this impairs the characteristics concerning the surge limit of the turbocompressor.

Another possibility would be the series connection of two stages with a connecting pipeline without an intercooler. Besides the extra cost for a second pinion shaft end and two complete spiral stages, this leads to additional flow losses because of the double conversion of pressure energy and velocity energy, additional leakage losses at the outlet of the pinion shaft from the spiral housing, and mechanical frictional losses.

SUMMARY AND OBJECTS OF THE INVENTION

It is an object of the present invention to provide a geared multishaft turbocompressor, which avoids the above-mentioned disadvantages of the state of the art and particularly to provide a geared multishaft turbocompressor involving high overall pressure ratios wherein satisfactory mechanical behavior is achieved at a high overall efficiency and low cost of construction.

According to the invention, a geared multishaft turbocompressor is provided with impellers arranged in series in terms of flow. Two or more compressor impellers are driven directly via a central gear or indirectly via pinion shafts on the circumference of the central gear and are attached to one or more pinion shafts arranged in parallel to one another. In stages following the low-pressure stages (first pinion shaft or first and second pinion shafts), a plurality of impellers are arranged on at least one pinion shaft end in series as a high-pressure group beginning from the second or third pinion shaft, via an intermediary of a disk-type diffuser and of a return ring.

A high-pressure stage group is preferably arranged on one side of a pinion shaft and only a dummy piston is arranged on the other side. Connection pieces for feeding in or removing gases may be provided to increase or decrease the gas flow being delivered, arranged at one or more return rings. Impellers of high-pressure stages are preferably connected to one another by radial serrations and central pins. The inner housing may be designed with a horizontal parting line and the horizontal, undivided outer housing surrounds the divided inner housing with the rotor. The gearbox case with the divided inner housing forms an additional housing chamber, and that a relief line is connected to the housing chamber.

The impellers of one stage group may be designed with a cover disk. The impeller of the first stage of a stage group is preferably designed without a cover disk. The impeller of the first stage of a stage group preferably has a smaller external diameter than that of the stage connected via the return ring. One or more impellers of one stage group are made of a material of a density lower than that of steel. One or more pinion shafts with high-pressure stages are mounted in magnetic bearings and the corresponding pinion shafts and the central gear may have axial pressure cogs.

Two or more impellers of one pressure group may be attached to the pinion shaft end with common radial serrations. The common radial serrations are preferably arranged in the area of the center of gravity of the impellers. The housing walls of the impeller chambers may be provided with radial twist-breaking grooves. In labyrinth glands, sealing gas feed lines open in the central area of the labyrinths, and that twist-breaking ribs are arranged at right angles to the circumferential direction in the edge zones of the leak flow inlet side of the labyrinths. An adjustable preguide wheel is arranged in front of the first stage of a stage group, and an adjustable afterguide wheel is arranged in the last stage of the stage group.

The radial expander (turbine), is formed as a result of reversal of the direction of rotation and flow of the geared multishaft turbocompressor i.e., by admitting the gas on the high-pressure side and discharging the gas on the low-pressure side. The outlet spiral of the high-pressure stages of the compressor may be used as the inlet spiral of a radial expander, the disk-type diffuser of the high-pressure stages of the compressor may be used as an inlet annular space of a radial expander. The return ring of the high-pressure stages of the compressor is preferably designed as a return ring of the radial expander, and the suction hole of the high-pressure stages of the compressor is preferably designed as an outlet diffuser of the radial expander. The diffuser blades of the high-pressure stages of the compressor are designed as an inlet guide wheel of the radial expander. The return ring of the radial expander is preferably not bladed.

According to a further aspect of the invention, two variants are arranged in a common machine particularly high-pressure stage groups of turbocompressors and of radial expanders for different media are arranged on a common pinion shaft.

The object of the present invention is attained with the geared multishaft turbocompressor formed by a plurality of impellers being arranged in series, via the intermediary of a disk-type diffuser and of a return ring, on at least one pinion shaft end in the stages following the low-pressure stages (first stage or first and second stages), beginning from the second or third pinion shaft.

The low-pressure stages may be designed as conventional single stages, which rotate at high circumferential velocity and high absorption capacity in the usual manner and thus already bring about a great reduction in the volume flow rate.

The suction to the first impeller of the high-pressure stage group formed by one or more return stages and one spiral end stage takes place via an axial suction hole.

The disk-type diffuser joining the impeller may be unbladed or may be designed with diffuser guide blades. Due to the direct transfer of the outlet flow from the disk-type diffuser into the subsequent stage via the return ring and due to the arrangement of the last stage of each stage group directly next to the gearbox case, a compact design is obtained, which minimizes the distance between the center of gravity of the impellers and the supporting bearing arranged in the gearbox case.

Pressure losses resulting from double pressure conversion (deceleration to the pipeline velocity and subsequent acceleration to the impeller inlet velocity of the subsequent stage) are also avoided due to the direct transfer of the outlet flow into the subsequent stages of one stage group.

The speed can be considerably reduced due to the division of the specific compression work, which is otherwise to be performed by one impeller of high circumferential velocity and speed, among two or more stages. More favorable conditions in terms of rotor dynamics can thus be achieved, despite the greater overhang of the shaft.

The following advantages are achieved in terms of fluidics:

While the volume flow rates are maintained, the diameters of the impellers increase as the speed decreases, and the volume flow rates increase if the impeller diameters are maintained. Both effects favorably influence the flow efficiency in the case of the small impeller diameters, which are used especially in the high-pressure part, and at the frequently low volume flow rates.

Extensive equalization of the opposite axial thrusts caused by flow forces takes place between the two high-pressure stage groups in the case of the opposite arrangement in the direction of flow of one high-pressure stage group each on the two shaft ends of a pinion shaft. However, if only one high-pressure stage group is present on one shaft end, a dummy piston is arranged at the other shaft end, especially in view of changing operating states, if there is no more place for this dummy piston on the shaft end with the stage group according to the present invention, which has a greater shaft overhang than a single stage, in view to the position of the critical speeds.

This dummy piston is especially suitable for changing operating pressures of the compressor, when the gas generating the axial thrust is sent from the impeller chamber behind the last stage of the high-pressure stage group arranged on the same pinion shaft to the rear side of the dummy piston, and the gas suctioned in from the high-pressure stage group is sent to the outer end of the dummy piston.

It may become necessary to arrange inlet or outlet holes for feeding in or removing gas at the return rings of the uncooled stage groups for process-related reasons when the feed or removal pressure predetermined by the process is between the inlet pressure and the outlet pressure of a high-pressure stage group.

The impellers can be connected via radial serrations, preferably Hirth-type serrations. This makes possible a horizontally undivided design of the housing rings, as in the conventional single stage.

The radial serrations consist of radial grooves, which are milled in the end surfaces of the impellers. These engage one another, as a result of which they are radially centered, and they transmit the torque.

The components geared with one another are held together axially by a central reduced-shaft bolt, which is screwed into the pinion shaft. The radial serration elements may also be manufactured separately and may be attached to the impellers.

To reduce the number of the axially detachable shaft connections because of the radial displacements of the rotor components in relation to one another, which becomes possible as a result within the framework of their manufacturing tolerances, it may become :necessary to permanently connect the impellers of one stage group to one another, e.g., by a slip joint, and to attach them to the pinion shaft only with common radial serrations. This requires a horizontal parting line at the housing ring arranged between the impellers of a stage group. The outer housing, including the suction-side and pressure-side covers, may remain undivided.

The radial serrations may be arranged in the connected hub of the impeller group such that they are located approximately in the center of gravity of the impellers.

According to another embodiment of the present invention, the inner housing is designed with a horizontal parting line and is surrounded by a horizontally undivided outer housing. The entire rotor can be mounted in this case in the gear mechanism without disassembly after balancing. However, in contrast to the pot-shaped design in single-shaft compressors, the jacket housing cannot be closed by a horizontally undivided cover on the gear mechanism side.

The leakage of gas through the remaining horizontal parting line toward the outside atmosphere under high gas pressures is reduced by reducing the intermediate pressure in the housing chamber between the inner housing and the gearbox case via relief lines.

In the case of multistage arrangement of the impellers, it is advantageous, because of the thermal expansion of the rotor, to design the impeller with a cover disk. This is also possible at low circumferential velocities of the high-pressure stage group compared with the single-stage design with high circumferential velocities.

If the critical speeds become too low because of the longer overhang of the shaft end of a high-pressure stage group, despite the reduction of the speed of the pinion shaft, the first impeller of the stage group is designed according to the present invention with a smaller external diameter than the impellers of the subsequent stages and/or, if necessary, without a cover disk, in order to reduce the weight of the rotor and to displace the center of gravity. Other variants include making one or more impellers of a material whose density is lower than that of steel, e.g., titanium or aluminum alloys.

In an advantageous embodiment of the present invention, rotor dynamic problems are solved, especially in the case of rotors with a long overhang in the high-pressure range, by using active magnetic bearings, which hold the rotor in its position via sensors and have a controllable damping.

Besides the radial magnetic bearings, it is also possible to use the prior-art pressure cogs at the gear pinions or separate axial magnetic bearings to absorb the residual axial thrusts.

Subsynchronous shaft vibrations, which may occur at high gas pressures, must be avoided especially in the case of the relatively long overhang of the shaft of the high-pressure stage groups according to the present invention. To avoid these causative twist flows in the labyrinths of the impeller and shaft glands with certainty, the housing walls of the impeller chambers are provided in this case with twist-breaking grooves, which remove the twist from the leakage flow already before entry into the labyrinth glands. The labyrinth glands are provided with twist-breaking ribs arranged at right angles to the circumferential direction on the leak flow inlet side for the still expectable residual twist. In addition, sealing gas without twist or opposite twist, which prevents rotating leak flows from entering the labyrinth gland from the impeller chamber, is introduced from the radially outer area of the impeller chambers into the labyrinths.

To obtain a broad working range at high partial load efficiency, axial preguide wheels and afterguide wheels with adjustable diffuser guide blades are used in compressors.

It is advantageous from the viewpoint of the cost of construction and fluidics to design the first stage of a stage group with an axial preguide wheel and the last stage with an adjustable afterguide wheel in front of the final spiral in the stage groups being considered here.

By reversing the direction of flow of the geared multishaft turbo engine designed as a geared multishaft turbocompressor, i.e., by admitting the gas on the high-pressure side and discharging the gas on the low-pressure side, with reversal of the direction of rotation, the geared multishaft turbo engine operates, with the basic design being the same, as a radial expander. In contrast to the conventional design, a constant or even greater gradient per pinion shaft end is achieved with good vibration stability due to the stage arrangement according to the present invention in the high-pressure part.

The outlet spiral of the compressor now becomes the inlet spiral of the radial expander, the unbladed or bladed disk-type diffuser becomes the intake guide blade, and the suction hole of the stage group becomes the discharge diffuser. The return ring may be designed as a bladed or unbladed return ring.

Only the profiling of the blade rows of the rotor blades, guide blades, and return blades is adapted to the reversed direction of flow.

At high pressure ratios, i.e., in the case of high enthalpy gradients in this case, the gas volume flow rates are still very low at the beginning of the expansion, and require small impeller diameters to achieve optimal volume flow rates. The speeds of the pinion shafts must be correspondingly high to maintain the circumferential velocity necessary for the enthalpy gradient in question. This would lead to the same gear mechanism problems in conventional stage arrangement as in the compressors.

The new design offers advantages even in the case of the combination of compressors and radial expanders in a common gearbox case. The cost of construction can be reduced by the combination of high-pressure stage groups of compressors and radial expanders on a common pinion shaft. To adapt the optimal speeds at a predetermined stage pressure ratio and enthalpy gradient, the number of compressor or radial expander stages of one pinion shaft can be varied and optimized.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
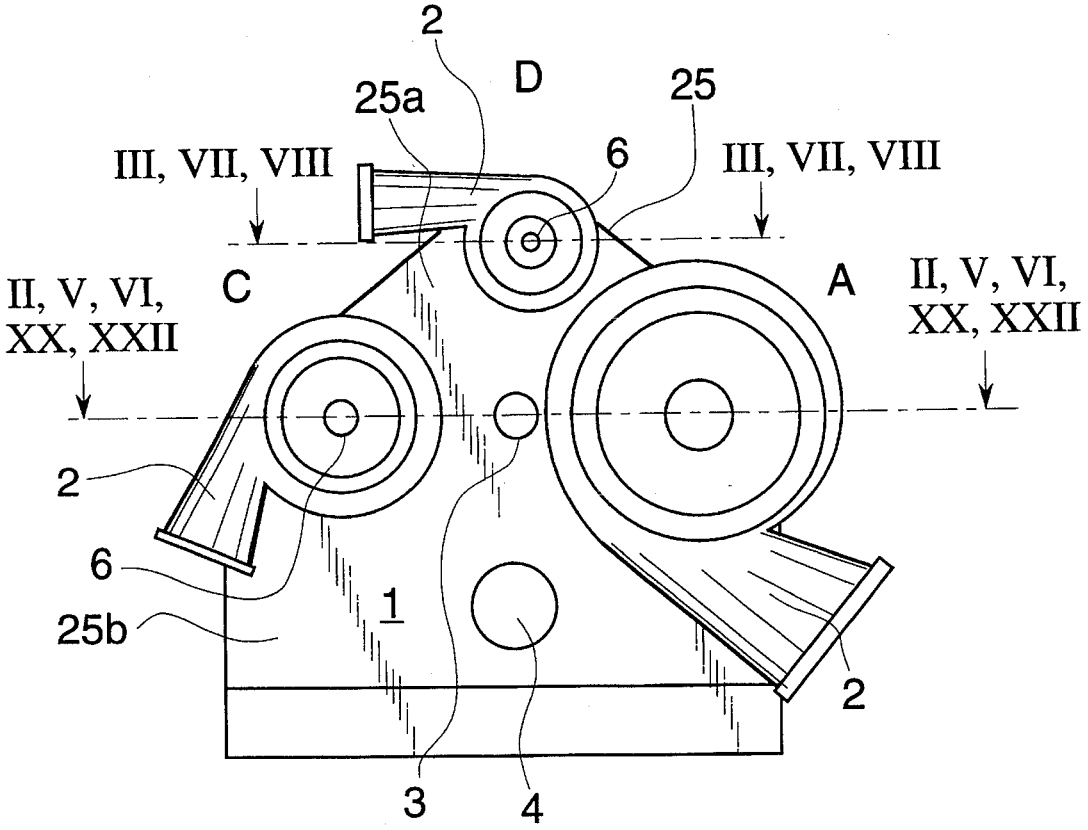
Fig. 1 (PRIOR ART)
FIG. 1 is a front view of a multistage geared multishaft turbocompressor according to the state of the art with three pinion shafts.

FIG. 1 shows the front view of a prior-art turbocompressor. Three compressor stages with spiral housing 2 are attached to a gearbox case 1. The three compressor stages are driven via a central drive shaft 3 or a pinion shaft 4 arranged at the circumference of the central gear.

Figure 2:
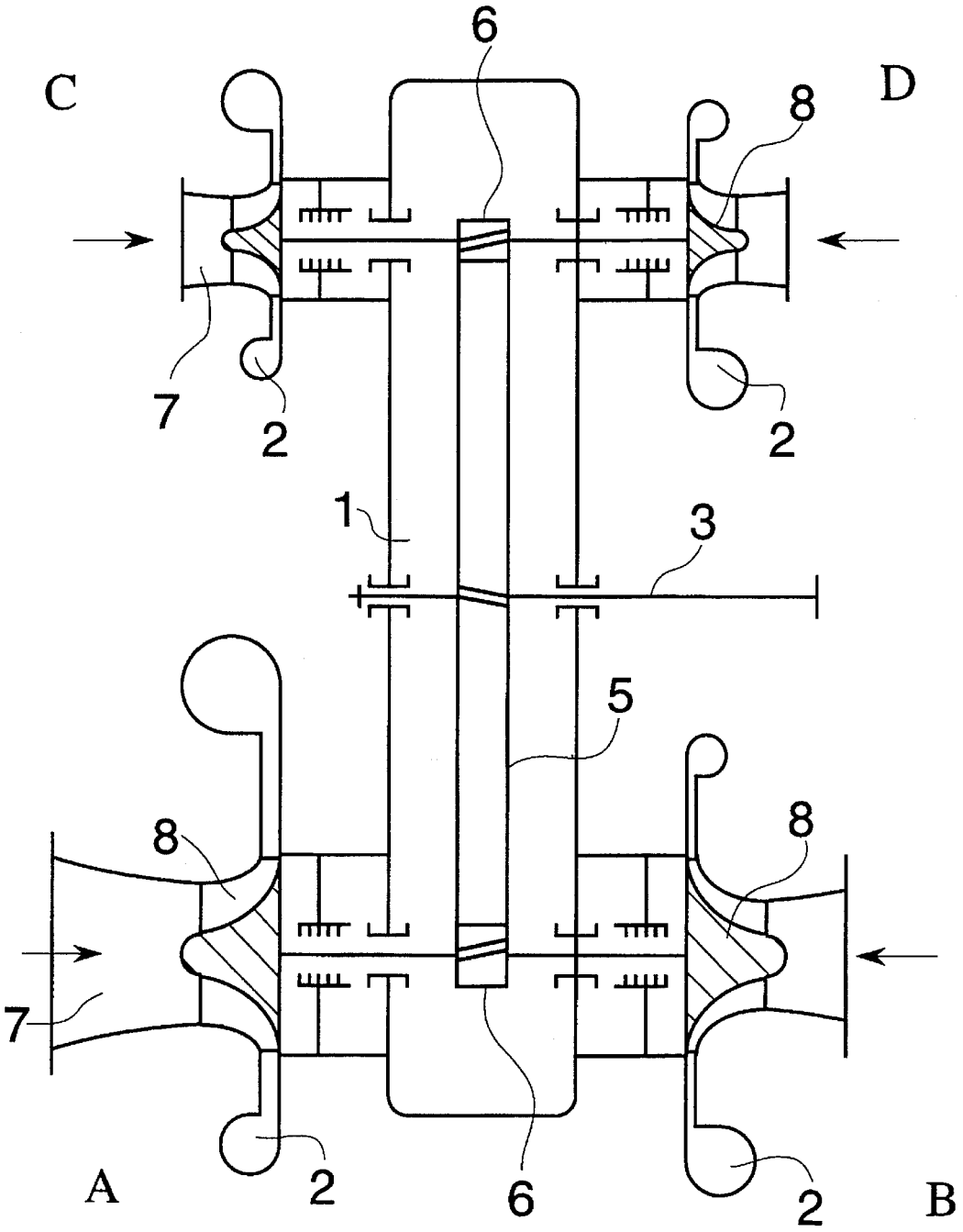
Fig. 2 (PRIOR ART)
FIG. 2 is a section II—II through the lower horizontal parting line of a turbocompressor according to FIG. 1.

FIG. 2 shows a section through the lower parting line of such a turbocompressor.

The gas enters the impeller 8 via the suction housing 7. The gas flow is slowed down in the spiral housing 2.

The impellers of stages A through D are made with increasingly smaller external diameters because of the increasing compression to maintain optimal volume flow rates.

Figure 3:
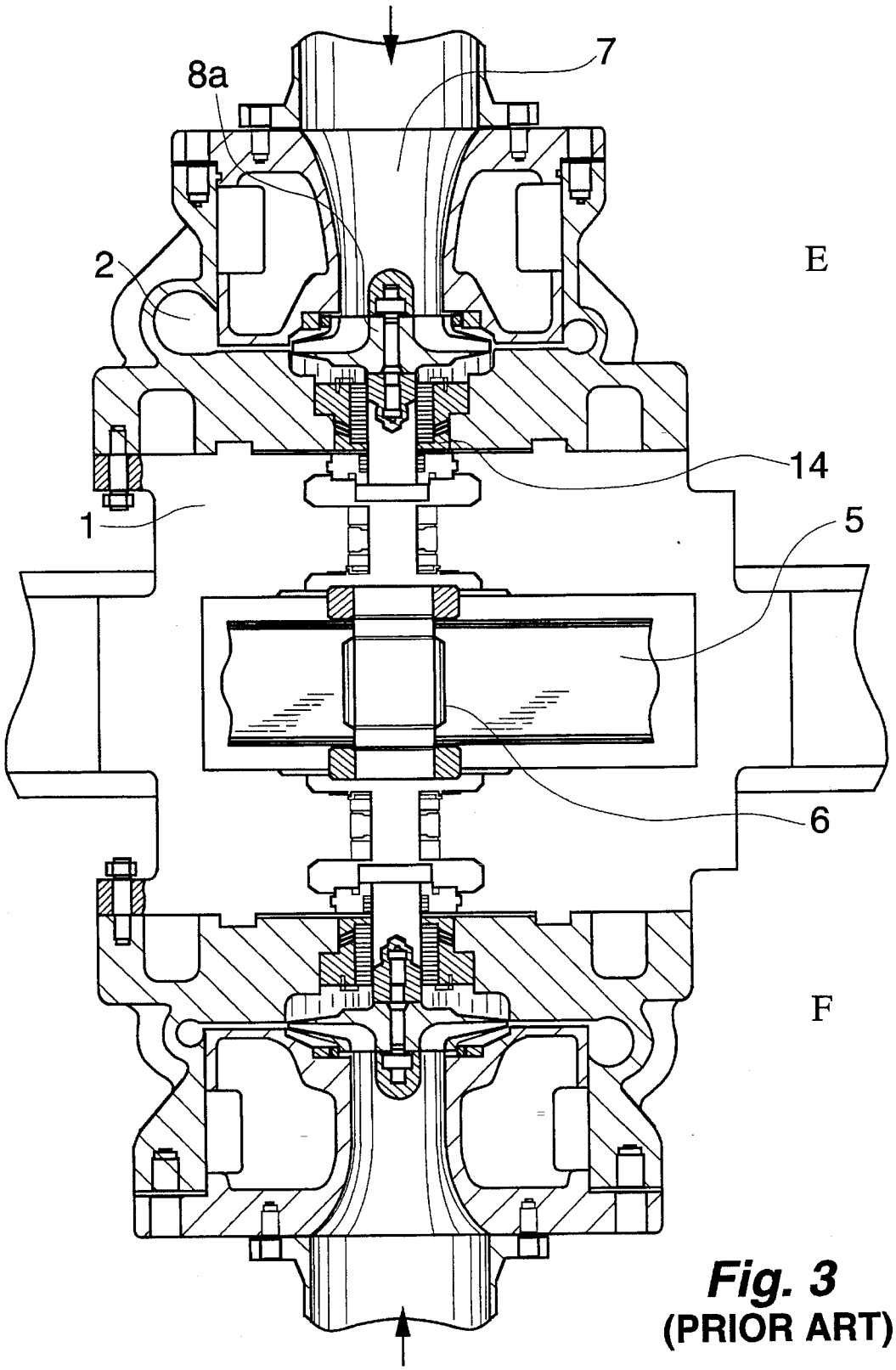
Fig. 3 (PRIOR ART)
FIG. 3 is a section V—V through the upper horizontal parting line of a turbocompressor according to FIG. 1, whose low-pressure part is designed according to FIG. 2.

FIG. 3, representing a section through the upper horizontal parting line of a turbocompressor according to FIG. 1, shows design details, such as the gear mechanism 5, 6, impellers 8*a*, the housing 1, etc. The low-pressure part is designed according to FIG. 2.

Figure 4:
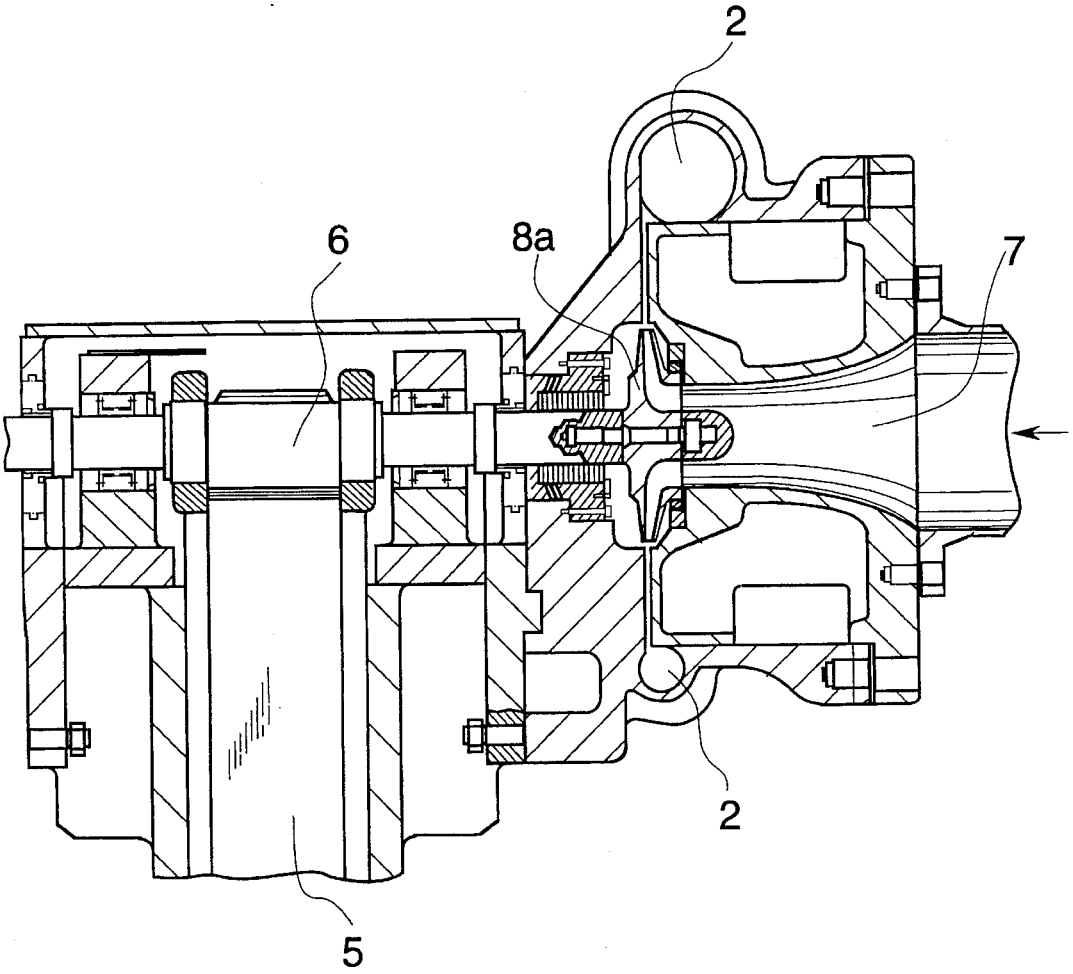
Fig. 4 (PRIOR ART)
FIG. 4 is a vertical section through a pinion shaft end of a geared multishaft turbocompressor according to the state of the art, according to FIG. 1.

FIG. 4 illustrates, in a vertical section through a pinion shaft end 6, design characteristics of the geared multishaft turbocompressor according to the state of the art according to FIG. 1.

Figure 5:
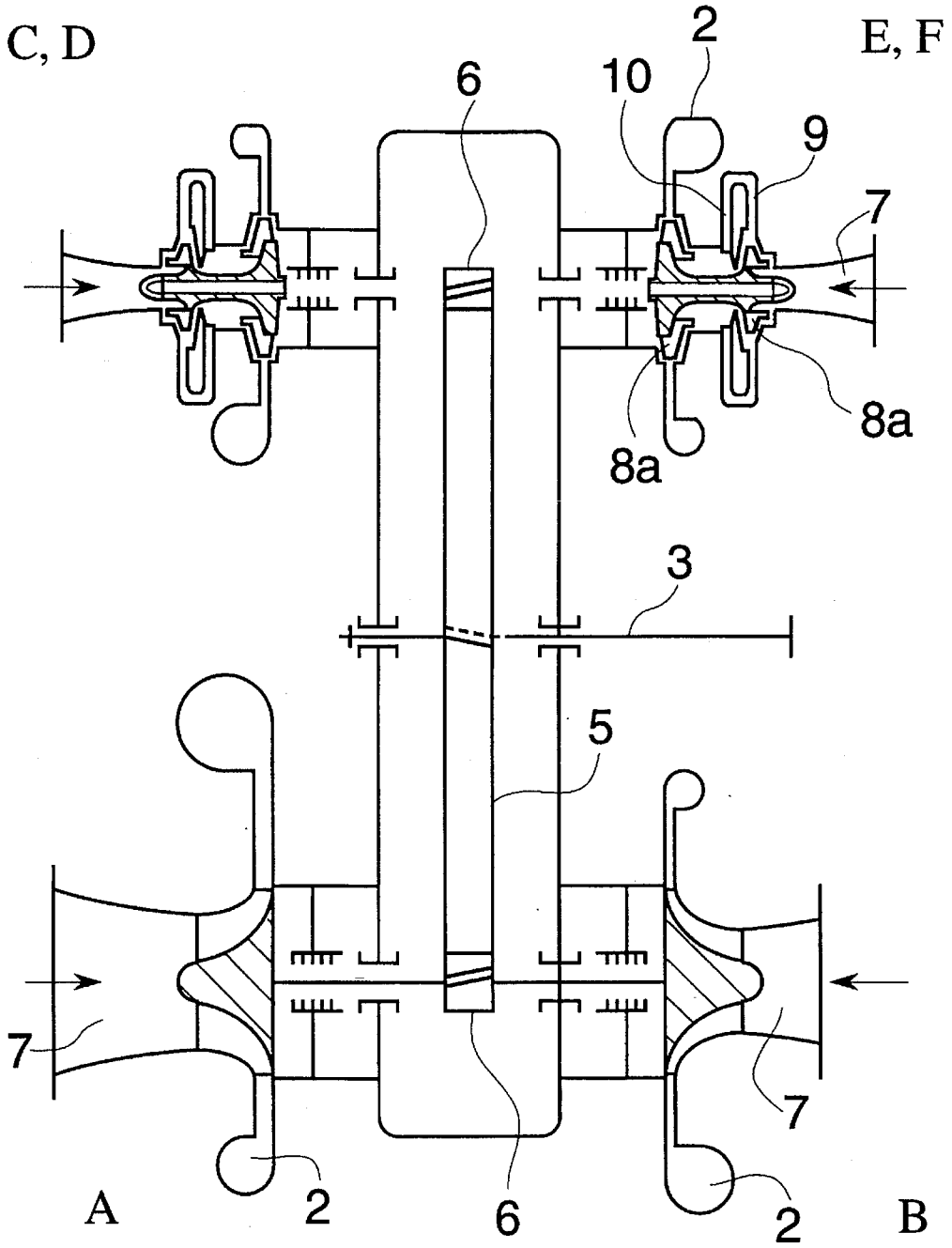
FIG. 5 is a sectional view based on the line V—V through the lower horizontal parting line of a turbocompressor according to the present invention with a conventional low-pressure shaft and a novel high-pressure shaft with the stages C through F.

The schematic design of a turbocompressor according to the present invention is shown in FIG. 5.

The turbocompressor with the spiral housings 2 and the suction holes 7 is equipped with a the conventional low-pressure shaft 6 with the stages A and B and with a the high-pressure shaft 6 according to the present invention with the stages C through F.

Two of the compressor impellers 8*a* each are arranged on the high-pressure shaft 6 on the same pinion shaft end with the same direction of flow. Disk-type diffusers 9 and return rings 10 are inserted in between.

Figure 6:
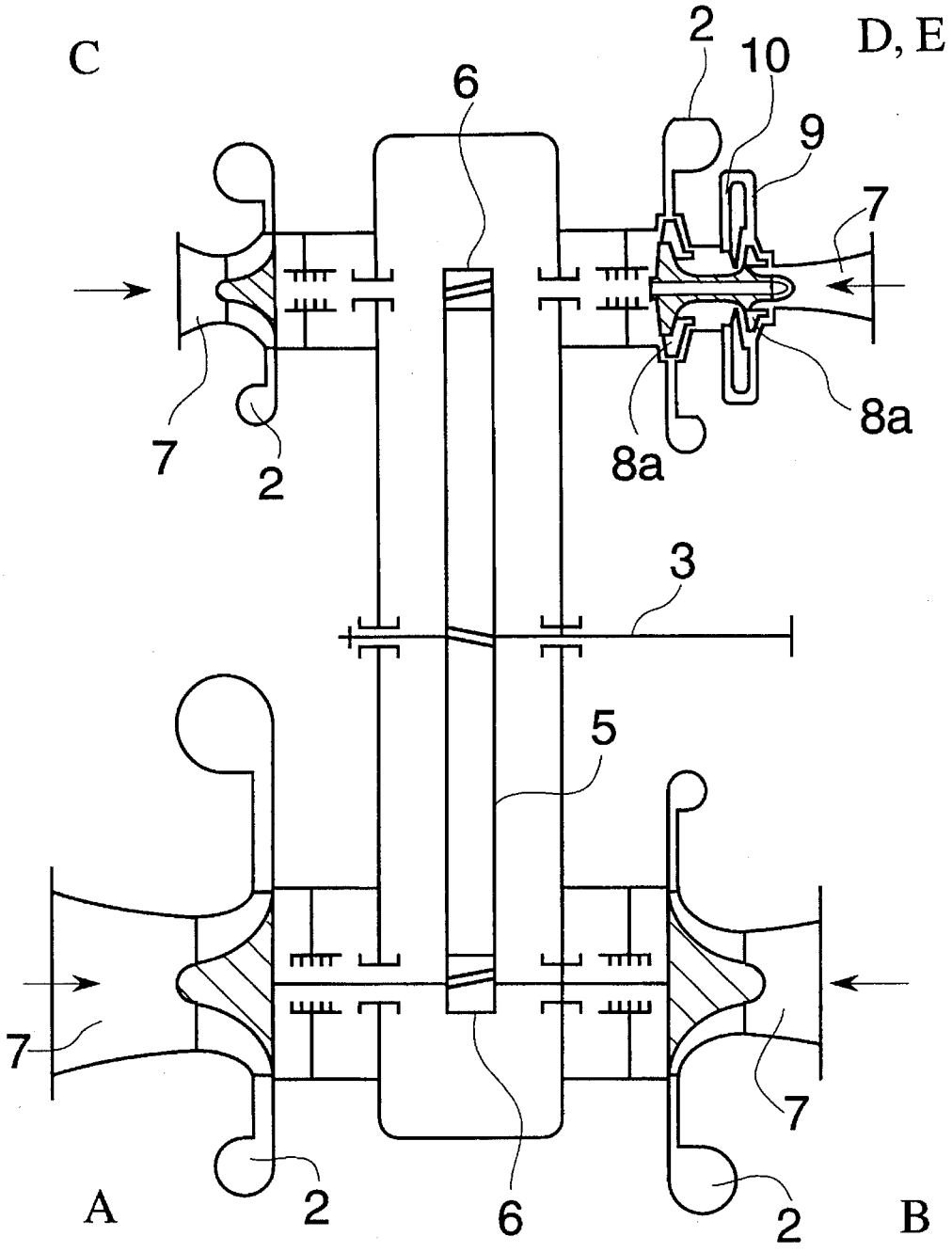
FIG. 6 is a sectional view based on a line VI—VI through the lower horizontal parting line of a turbocompressor according to the present invention with novel stages F and E.

FIG. 6 shows a section through the lower horizontal parting line of a turbocompressor according to the present invention with the high-pressure stages D and E according to the present invention, wherein two of the impellers 8*a* are arranged on the pinion shaft 6. The disk-type diffusers 9 and the return rings 10 are inserted here as well.

Figure 7:
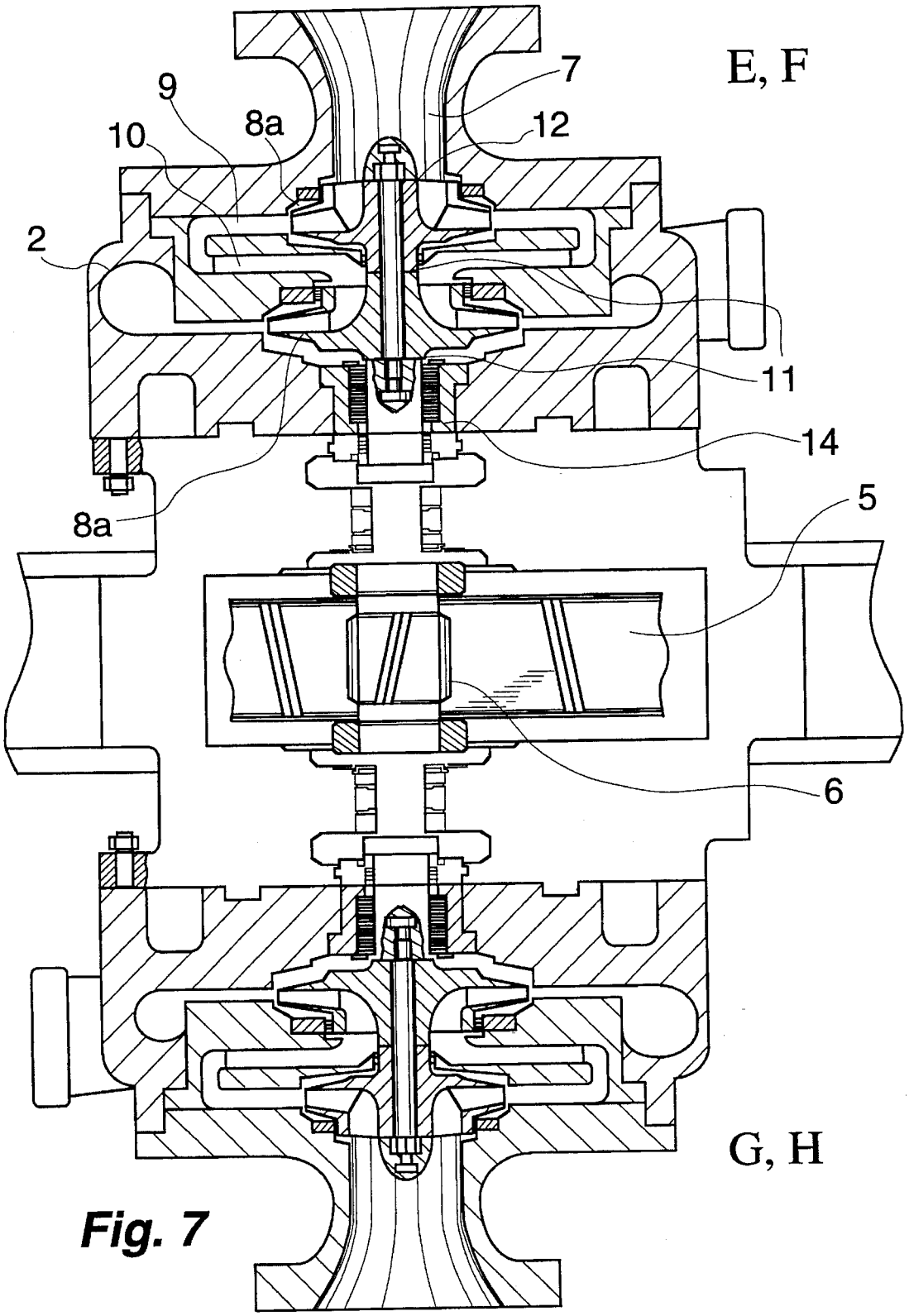
FIG. 7 is a sectional view based on a line VII—VII through the upper parting line of a turbocompressor according to the present invention, whose low-pressure part is designed according to FIG. 2, with two novel stages E, F, G, and H each at the pinion shaft ends.

FIG. 7, representing a section through the upper horizontal parting line of a turbocompressor according to the present invention, shows design details of two high-pressure stages E, F and G, H each at the pinion shaft ends 6. The low-pressure part in this turbocompressor has the conventional design according to FIG. 2. The first impeller 8*a* of the high-pressure stage group has a reduced external diameter. The impeller is fastened here by means of the prior-art Hirth-type serrations, namely, radial serrations 11 with a central fastening bolt 12. Shaft gland 14 is provided around the pinion shaft 6 at the compressor housing 2.

The axial thrusts generated by each stage group as a consequence of the pressure differences before and after the impeller are compensated due to the axially opposite arrangement of the two stage groups.

Figure 8:
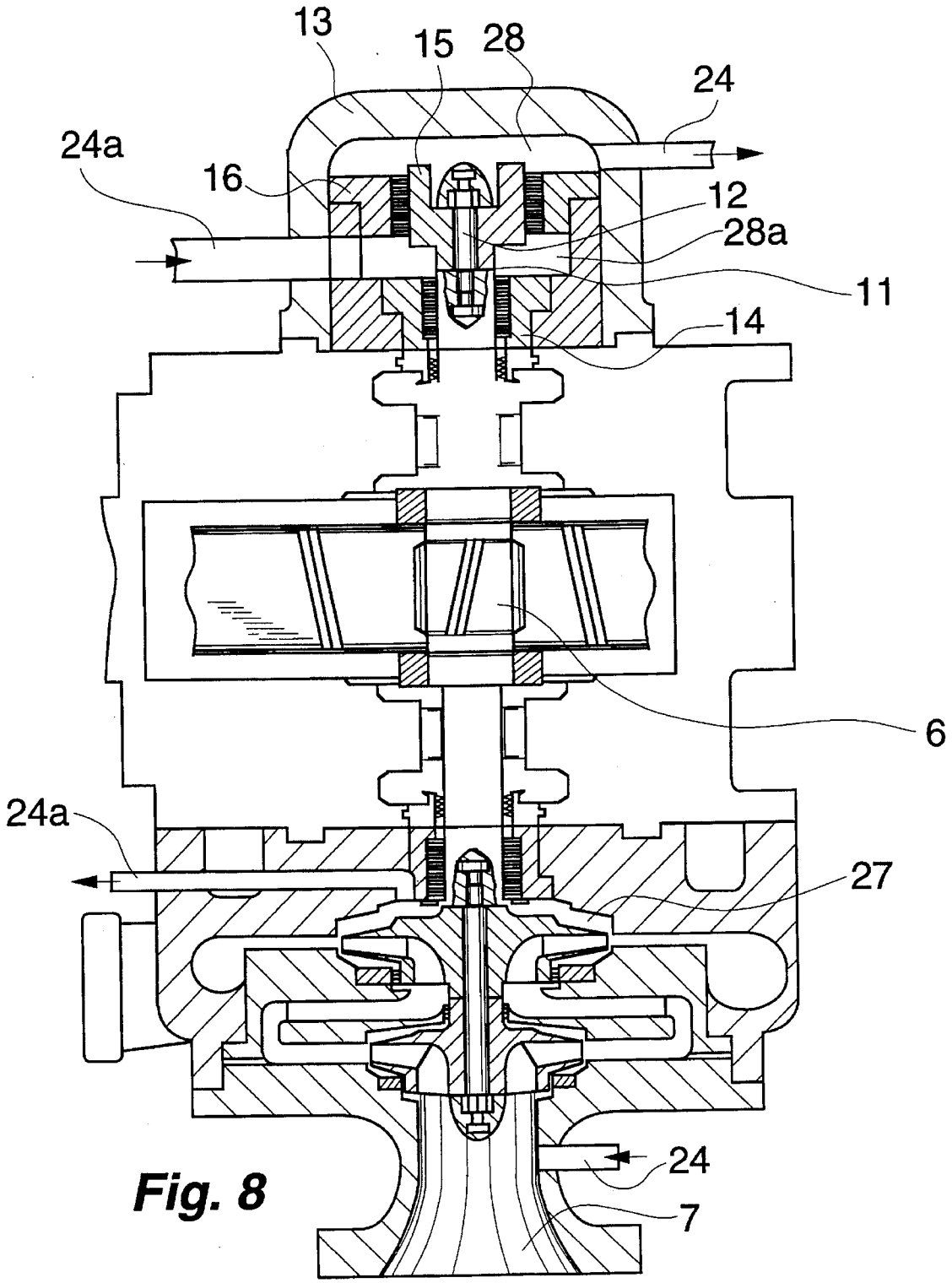
FIG. 8 is a sectional view based on a line VIII—VIII through the upper horizontal parting line of a turbocompressor according to the present invention with two novel stages and one dummy piston at the other pinion shaft end.

A dummy piston 15, which is used to compensate axial thrusts, is arranged within a pressure-proof housing 13 at the opposite pinion shaft end in the turbocompressor according to FIG. 8, which shows a compressor with two high-pressure stages at a the pinion shaft end 6.

Compressed gas is fed in this example from the impeller chamber 27 via the line 24*a* of the inner chamber 28*a* at the dummy piston, while the pressure level in the outer camber 28 is reduced via the relief line 24 leading to the suction hole 7 of the first stage of the stage group.

Figure 9:
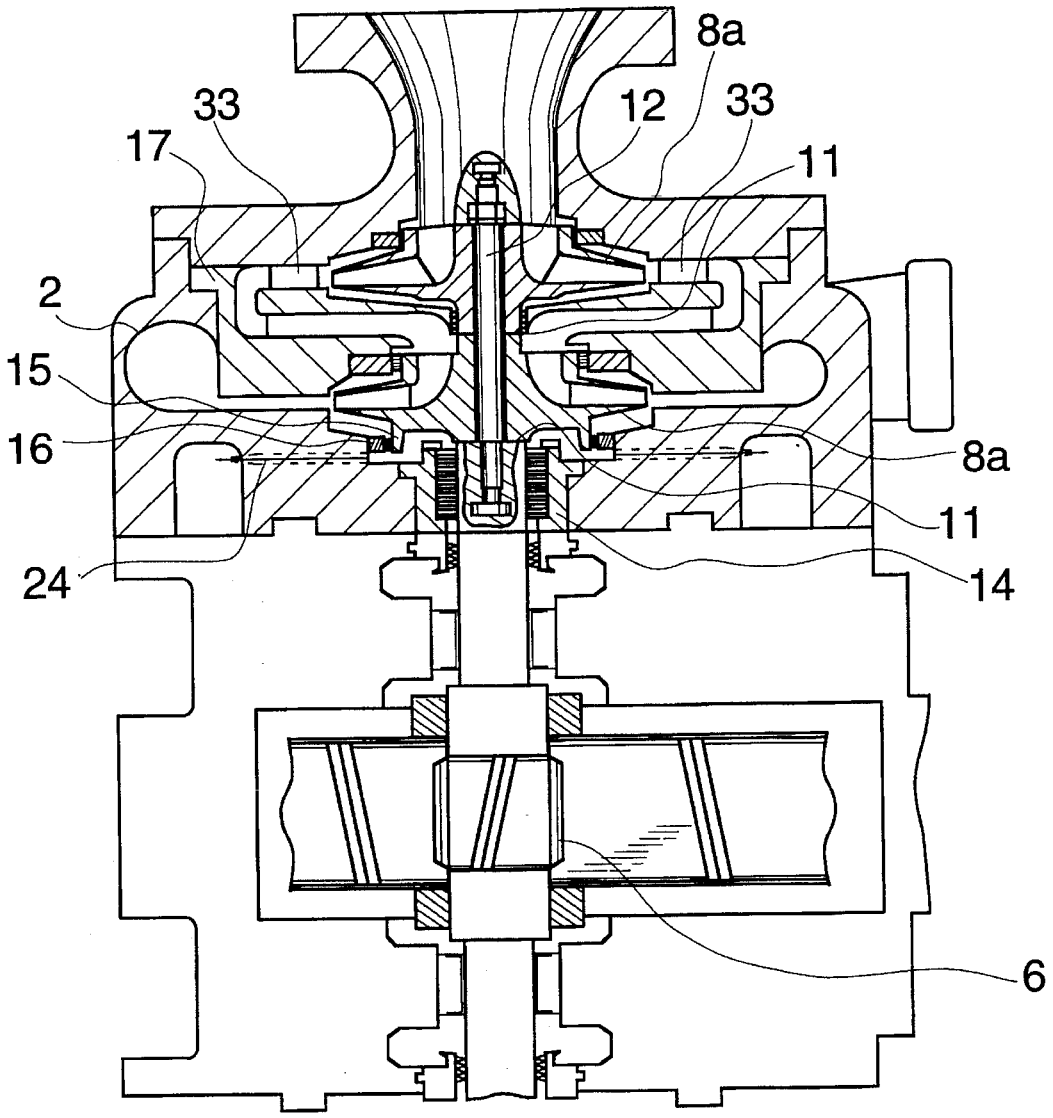
FIG. 9 is a horizontal sectional view taken through a pinion shaft end similar to FIG. 7, with dummy piston integrated within the impeller.

FIG. 9, representing a horizontal section through a the pinion shaft end 6, shows the design with two compressor impellers with the cover disk 8*a*, wherein both the impellers 8*a* have the same external diameter. The inner housing 17 is unbladed, and a the dummy piston 15 is integrated within the second impeller 8*a*.

Figure 10:
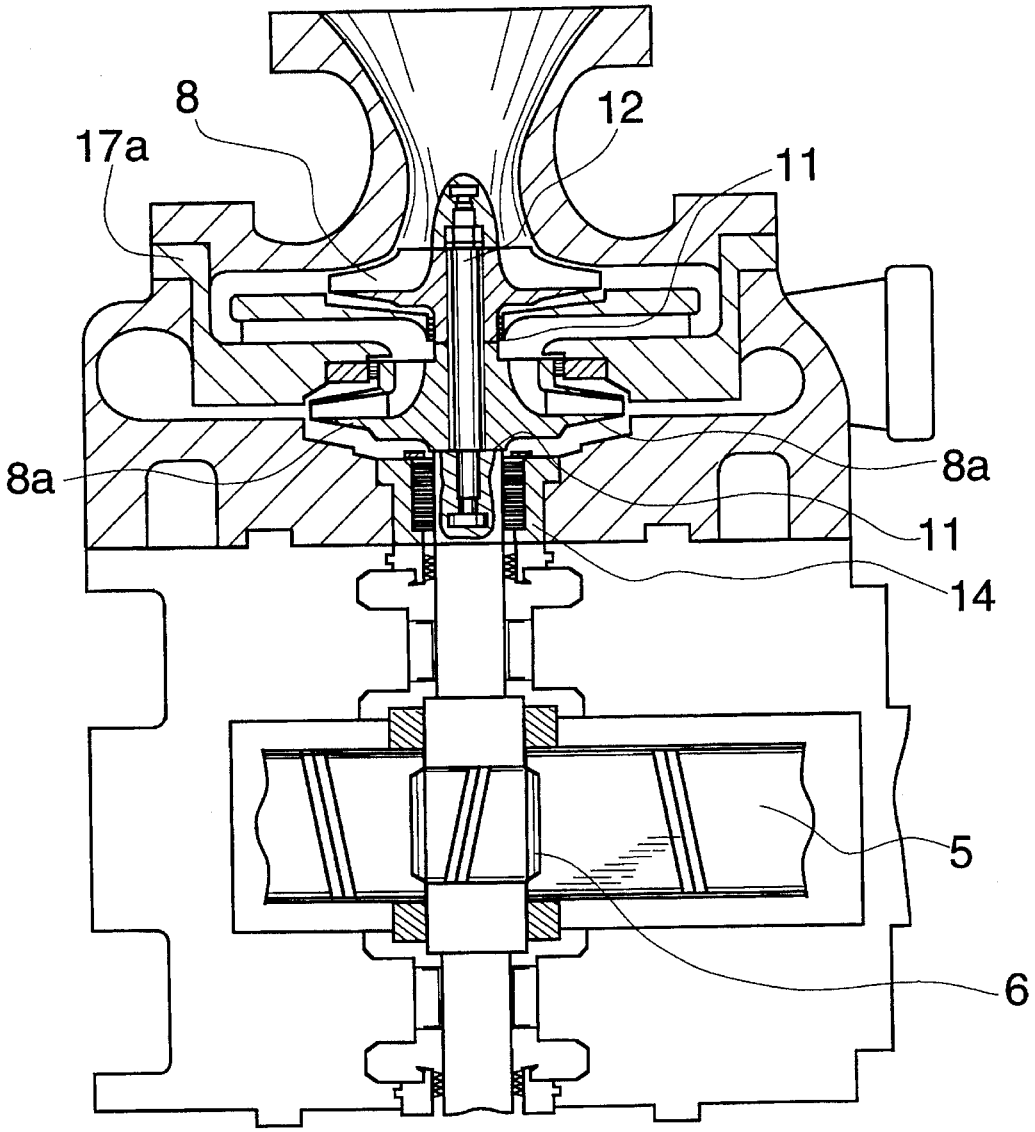
FIG. 10 is a horizontal sectional view taken through a pinion shaft end with a first stage without a cover disk.

FIG. 10 shows, in a horizontal section, the pinion shaft end 6 with an undivided inner housing of another design 17*a*. The first impeller 8 has no cover disk, and its external diameter is smaller than that of the subsequent stage with the cover disk 8*a*.

Figure 11:
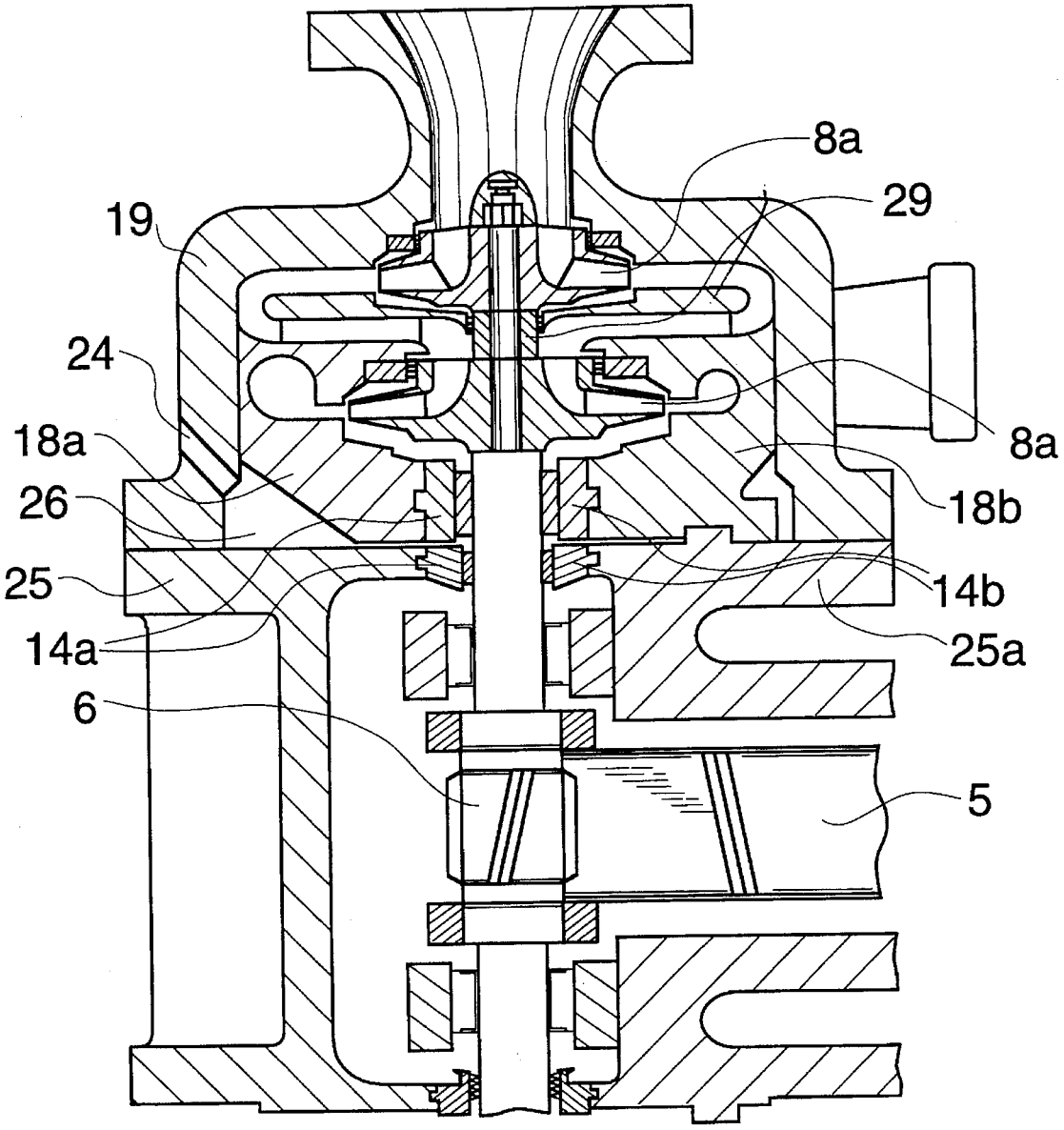
FIG. 11 is a vertical sectional view taken through a pinion shaft end with two impellers shrunk onto the shaft.

FIG. 11 shows the pinion shaft end 6 of a turbocompressor according to the present invention with two the impellers 8*a* shrunk onto the pinion shaft 6 with a shaft bushing 29 arranged between them. The compressor inner housing 18 is divided horizontally and is screwed with its lower part to the gearbox case. The inner housing upper part 18*a* is screwed to the inner housing lower part 18*b* after insertion of the pinion shaft 6.

The undivided outer housing 19 is subsequently pushed over it and is screwed axially to the gearbox case middle part 25*a* and gearbox case upper part 25, as a result of which an additional housing chamber 26, whose pressure can be released via the relief line 24, is formed.

Figure 12:
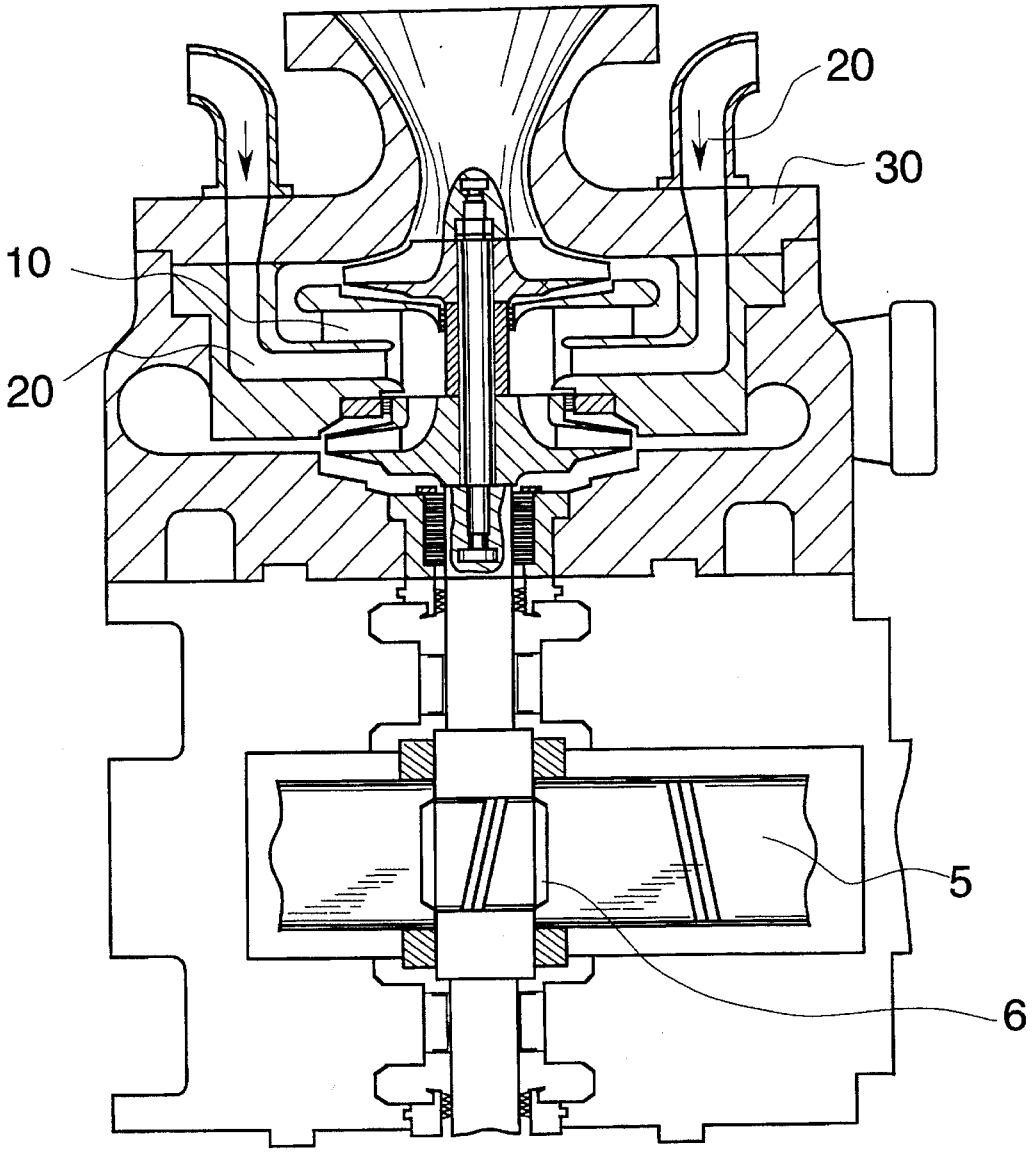
FIG. 12 is a horizontal sectional view corresponding to FIG. 10 with additional feed channels.

A turbocompressor corresponding to FIG. 10 additionally has, according to the horizontal section according to FIG. 12, gas feed channels 20 between the compressor stages, which end in the suction-side housing cover 30.

Figure 13:
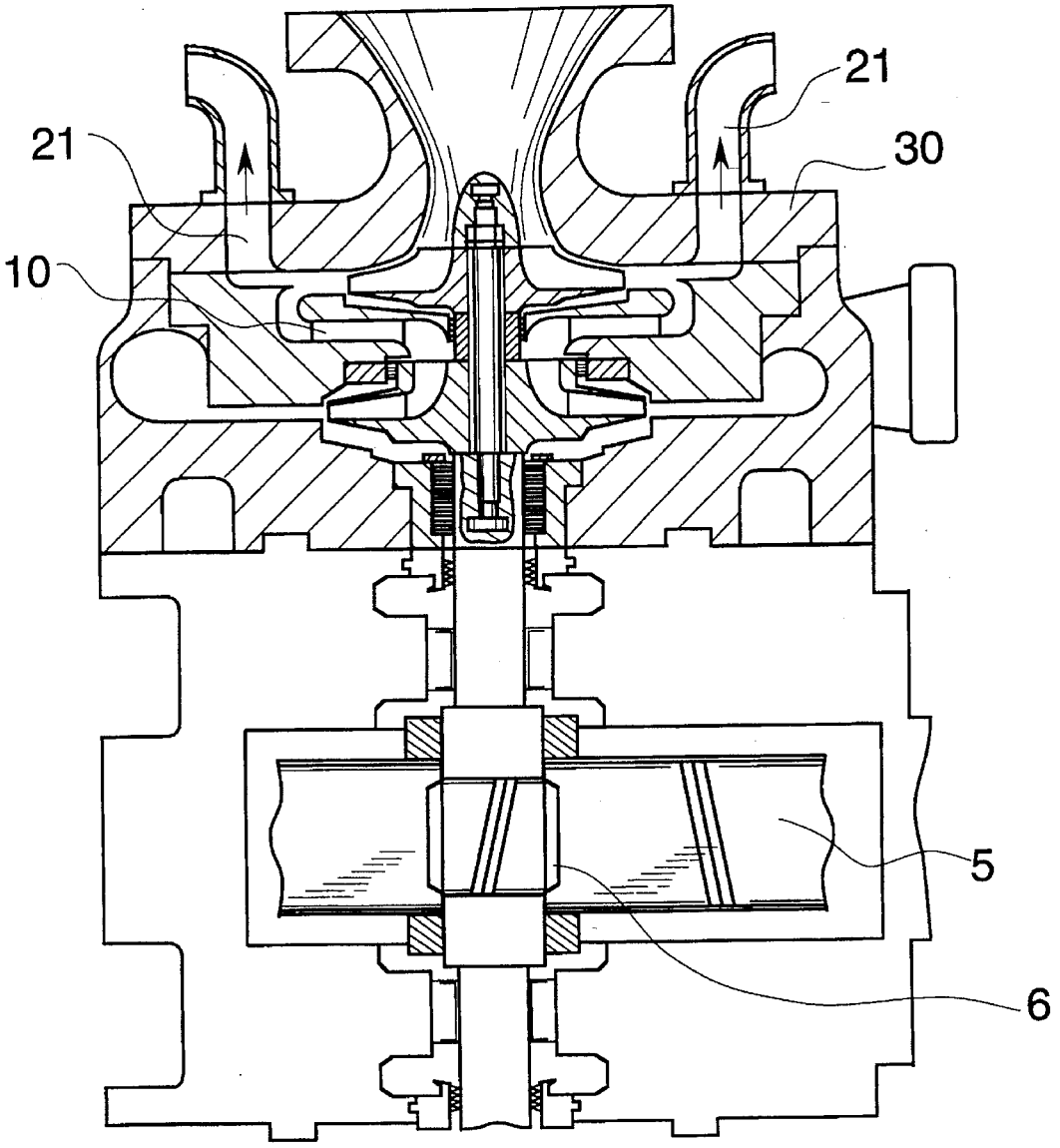
FIG. 13 is a horizontal sectional view corresponding to FIG. 10 with additional removal channels.

FIG. 13, representing a sectional view corresponding to FIG. 10, shows additional gas removal channels 21, which are shown between the two compressor stages represented and end in the suction-side housing cover 30.

Figure 14:
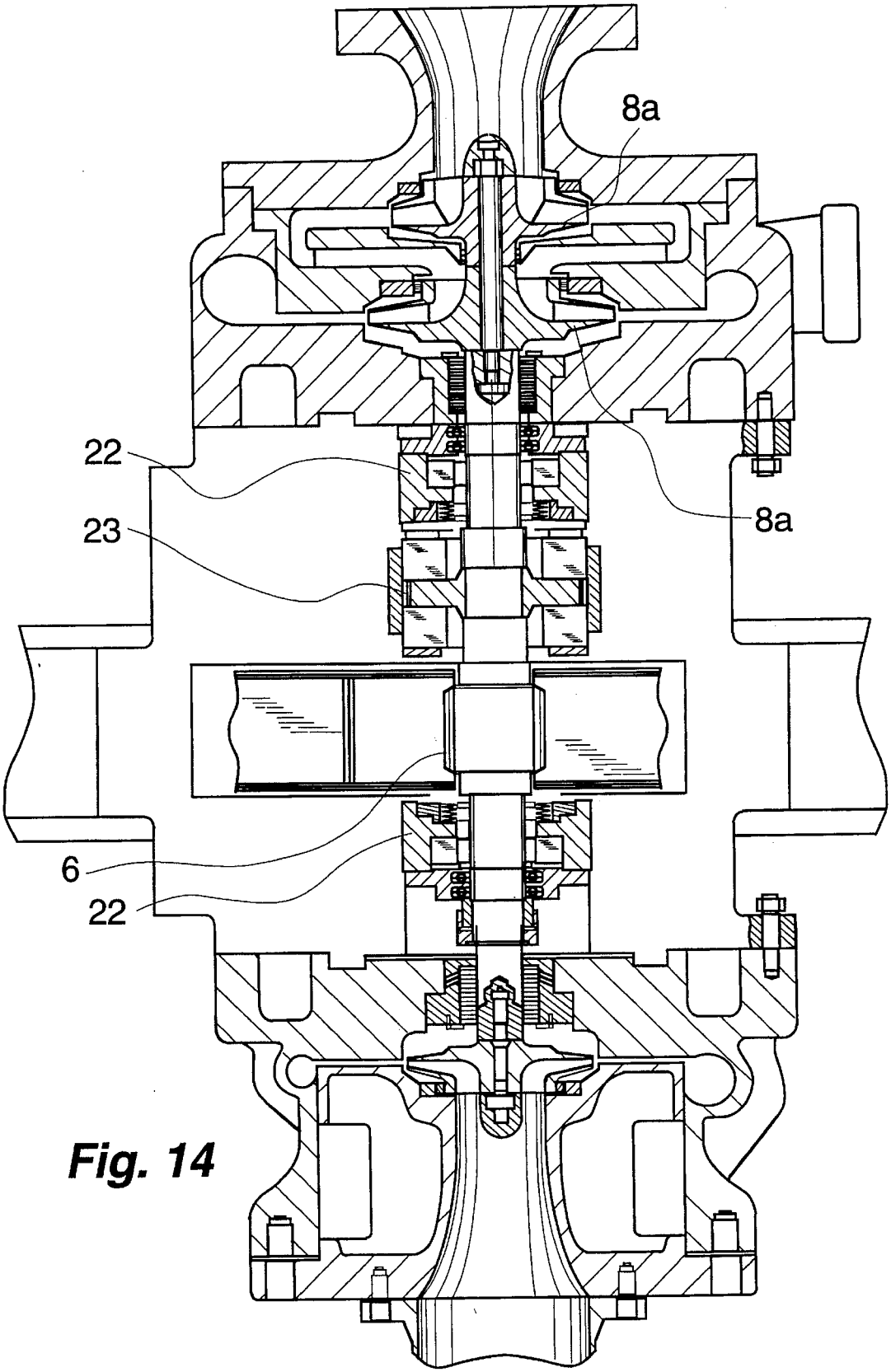
FIG. 14 is a sectional view through the upper horizontal parting line of a turbocompressor according to the present invention with an active magnetic bearing.

FIG. 14, representing a section through the upper horizontal parting line of a geared multishaft turbocompressor according to the present invention with the impellers 8*a*, indicates the radial magnetic bearings 22 and the axial magnetic bearing 23, which compensate dynamic problems by holding the rotor 6 in the desired position via sensors.

Figure 15:
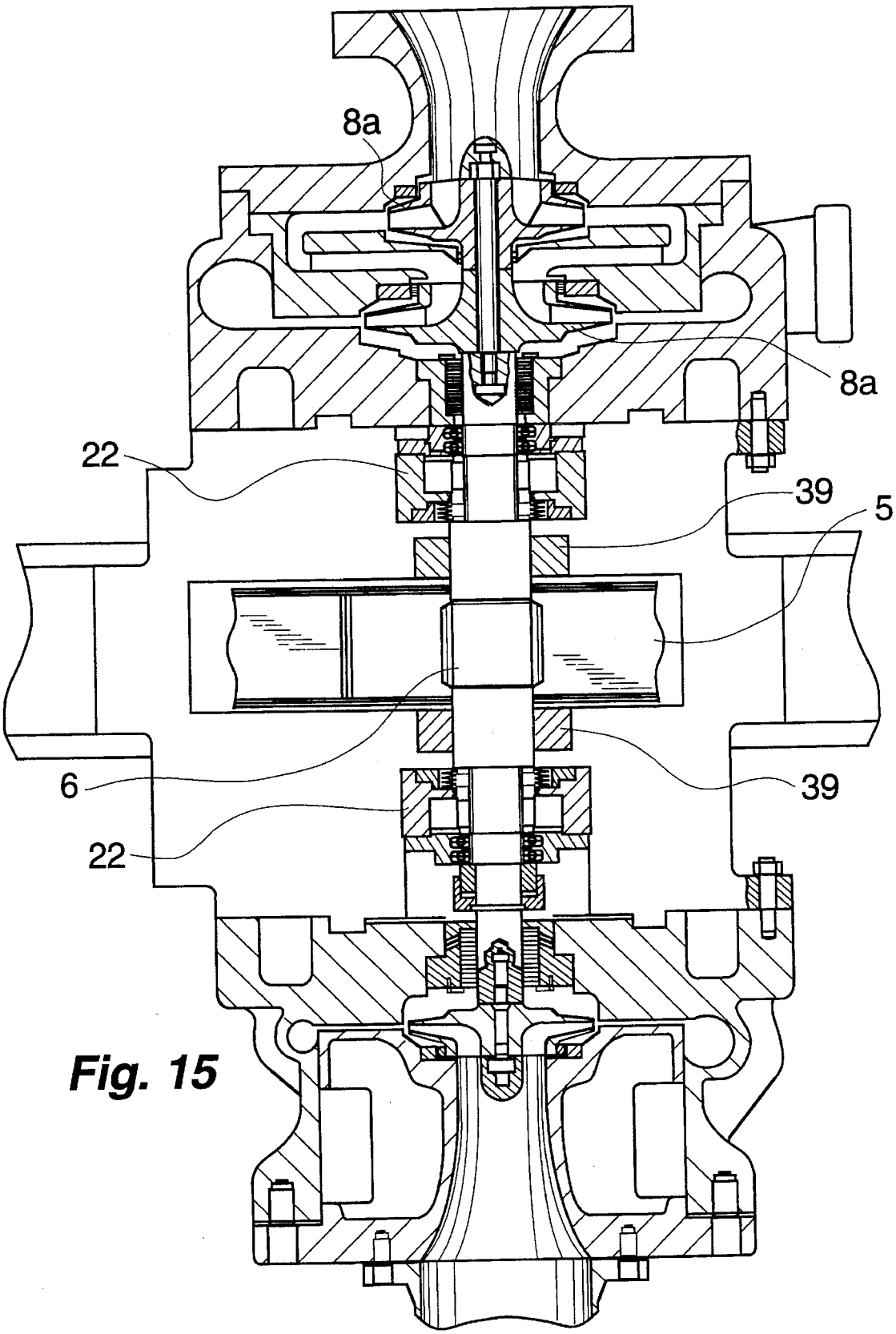
FIG. 15 is a sectional view through the upper horizontal parting line of a turbocompressor according to the present invention with radial active magnet bearing and axial pressure cogs at the pinion.

FIG. 15, representing a section through the upper horizontal parting line of a geared multishaft turbocompressor according to the present invention with the impellers 8*a*, shows radial magnetic bearings 22. The residual axial thrust is absorbed here in the conventional manner by pressure cogs 39 via the central gear 5 by the axial thrust bearing of the central gear shaft 3.

Figure 16:
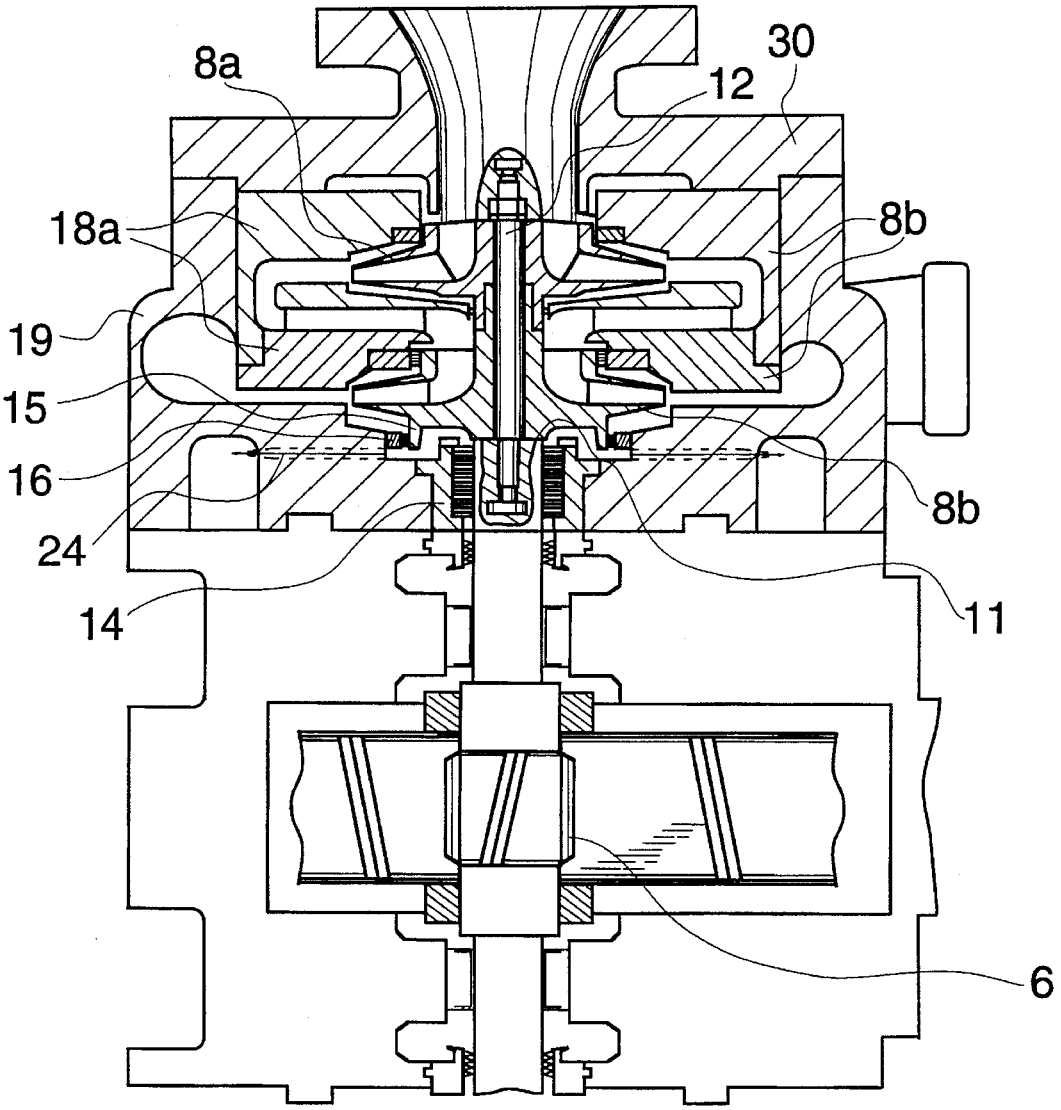
FIG. 16 is a horizontal sectional view through a pinion shaft end similar to FIG. 7 with two impellers with cover disk and with only one radial serration.

FIG. 16, representing a horizontal section through a the pinion shaft end 6, shows the design with two compressor impellers with the cover disk 8*a*, wherein both the impellers 8*a* have the same external diameter. The two impellers are rigidly connected to one another, and the impeller 8*a* with the cover disk is shown here shrunk onto the extended hub of the impeller 8*b*. As a result, only the Hirth-type serrations 11 are required, but the inner housing 18 must be designed as a horizontally divided housing 18*a*, 18*b* for mounting. The dummy piston 15 is integrated within the second impeller 8*b*.

Figure 17:
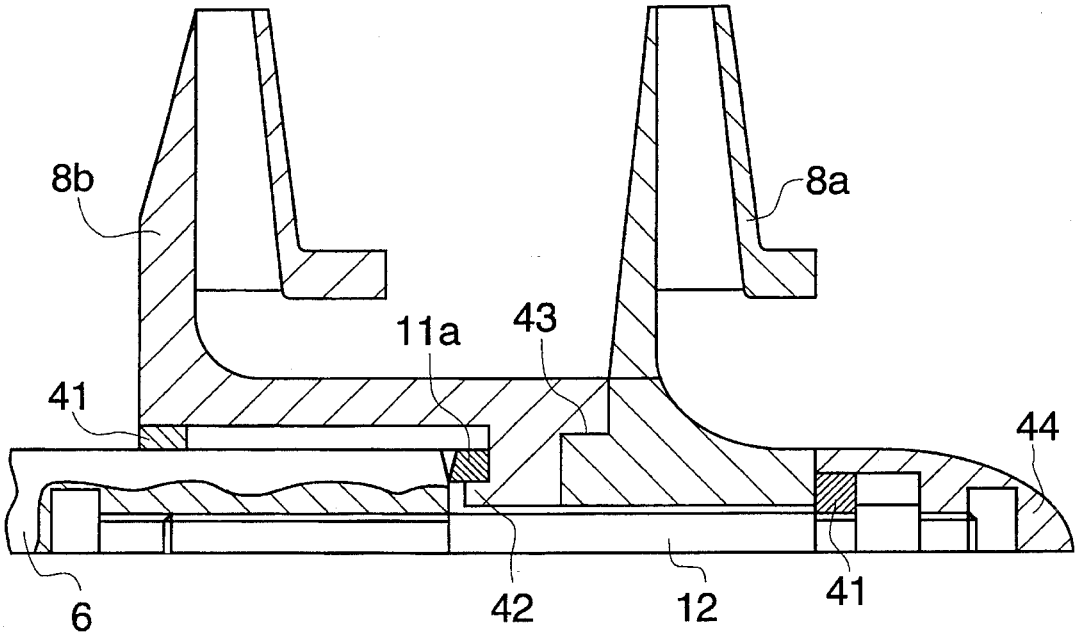
FIG. 17 is a sectional view through a pinion shaft end of a turbo compressor according to the present invention with Hirth-type serrations in the center of gravity of the stages.

FIG. 17 shows design details of an impeller fastening 8*a*, 8*b*. The second impeller 8*b* with extended hub of the high-pressure stage group surrounds with its extended hub the pinion shaft end 6, in the front of which Hirth-type serrations are milled. A ring 1 la with anti-Hirth-type serrations is inserted into the extended hub on a projection 42 for manufacturing reasons. The first impeller 8*a* is permanently connected shrunk, soldered, or welded to the second impeller 8*b* via a centering means 43.

The two impellers 8*a*, 8*b* together are arranged at the pinion shaft end 6 with the central fastening screw 12.

Figure 18:
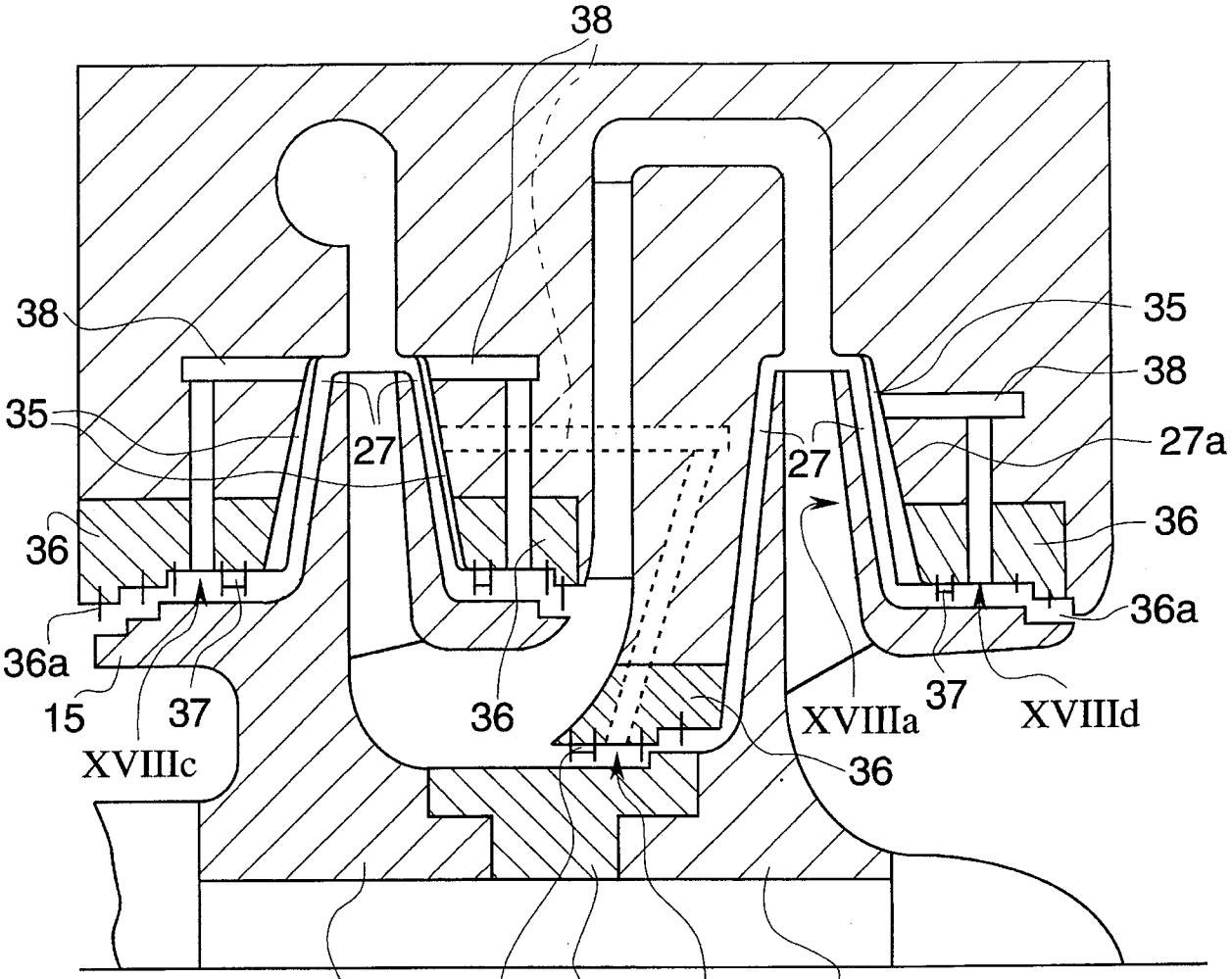
FIG. 18 is a sectional view through a shaft end of a turbocompressor according to the present invention with twist breakers and sealing gas admission.
Figure 18A:
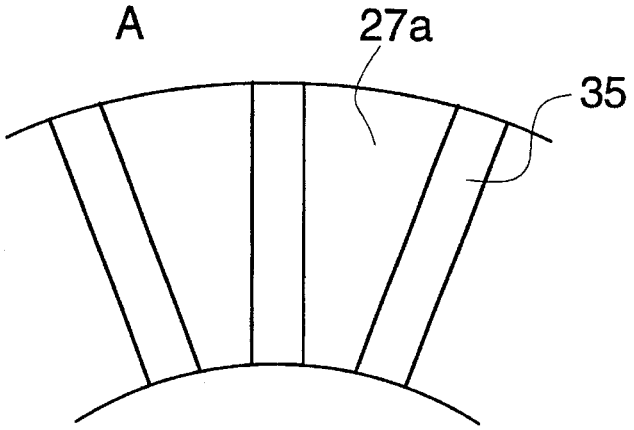
FIG. 18*a* is a view in the direction of arrow XVIII*a*—XVIII*a* of FIG. 18.
Figure 18B:
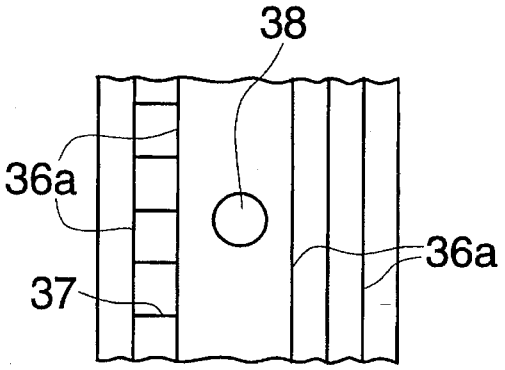
FIG. 18*b* is a view in the direction of arrow XVIII*b*—XVIII*b* of FIG. 18.
Figure 18C:
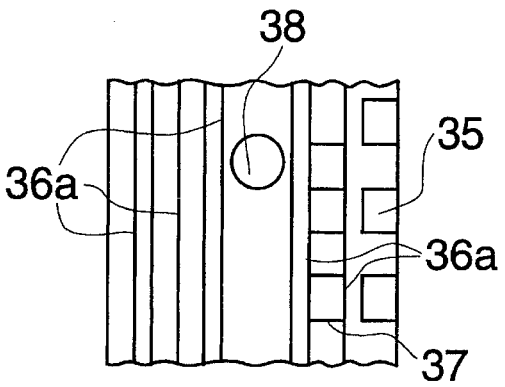
FIG. 18*c* is a view in the direction of arrow XVIII*c*—XVIII*c* of FIG. 18.
Figure 18D:
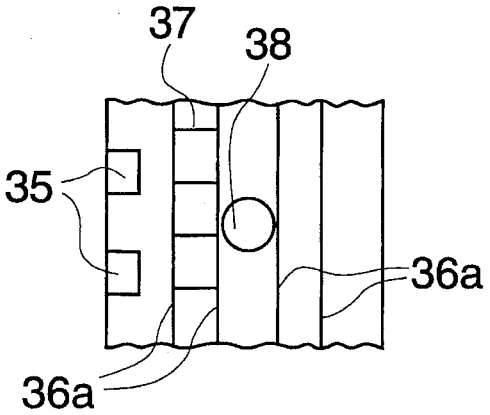
FIG. 18*d* is a view in the direction of arrow XVIII*d*—XVIII*d* of FIG. 18.

FIG. 18 as well as FIGS. 18*a*–18*d* show details concerning twist breakers and sealing gas admission.

The character designated arrows XVIII*a*, *b*, *c* and *d* shown in FIG. 18 designate the detail enlargements in FIGS. 18*a*–18*d*.

Radial twist-breaking grooves 35, which are to break the twist generated by the outer surfaces of the impeller in the leak flow to the labyrinth glands 36 of the impellers 8*a*, 8*b*, of the shaft 6, and of the dummy piston 15, are milled on the cover disk side in the impeller chamber 27 of the first and second impellers 8*a*, 8*b* and on the wheel disk side in the impeller chamber of the second impeller 8*b*. Twist-breaking ribs 37, which are to destroy twist components of the flow velocity that still have entered the labyrinth gland 36, are arranged in the labyrinth glands 36 on the gas inlet side at right angles to the circumferential direction.

As a consequence of the pressure difference between the radially outer area of the impeller chambers 27 and the suction opening of the impellers 8*a*, 8*b*, a sealing gas flow is introduced through the holes 38 into the labyrinth gland 36 of the impellers 8*a*, 8*b* in order to prevent still twisted flow from entering from the impeller chamber adjoining the labyrinth gland 36. The situation is analogous with the dummy piston 15.

The labyrinth gland 36 on the intermediate bushing 40 between the stages is supplied with sealing gas from the impeller chamber of the subsequent stage via the holes 38.

Figure 19:
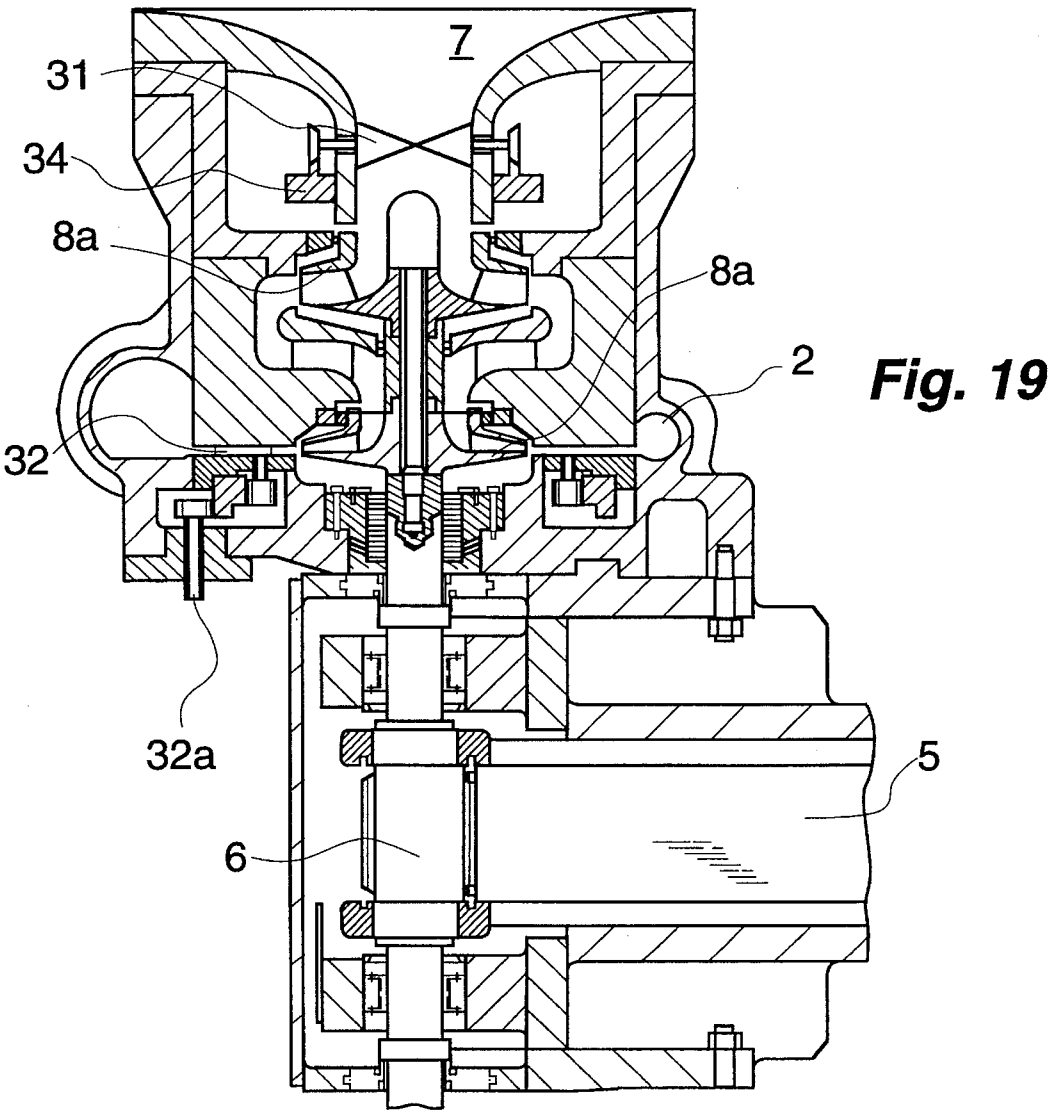
FIG. 19 is a vertical sectional view through a shaft end of a turbocompressor according to the present invention with axial preguide wheel in front of the first stage and with radial afterguide wheel in the last stage.

FIG. 19 shows a preguide wheel 31 with adjusting device 34 in front of the first stage of a compressor, as well as an afterguide wheel 32 with adjusting device 32*a* after the second stage.

Figure 20:
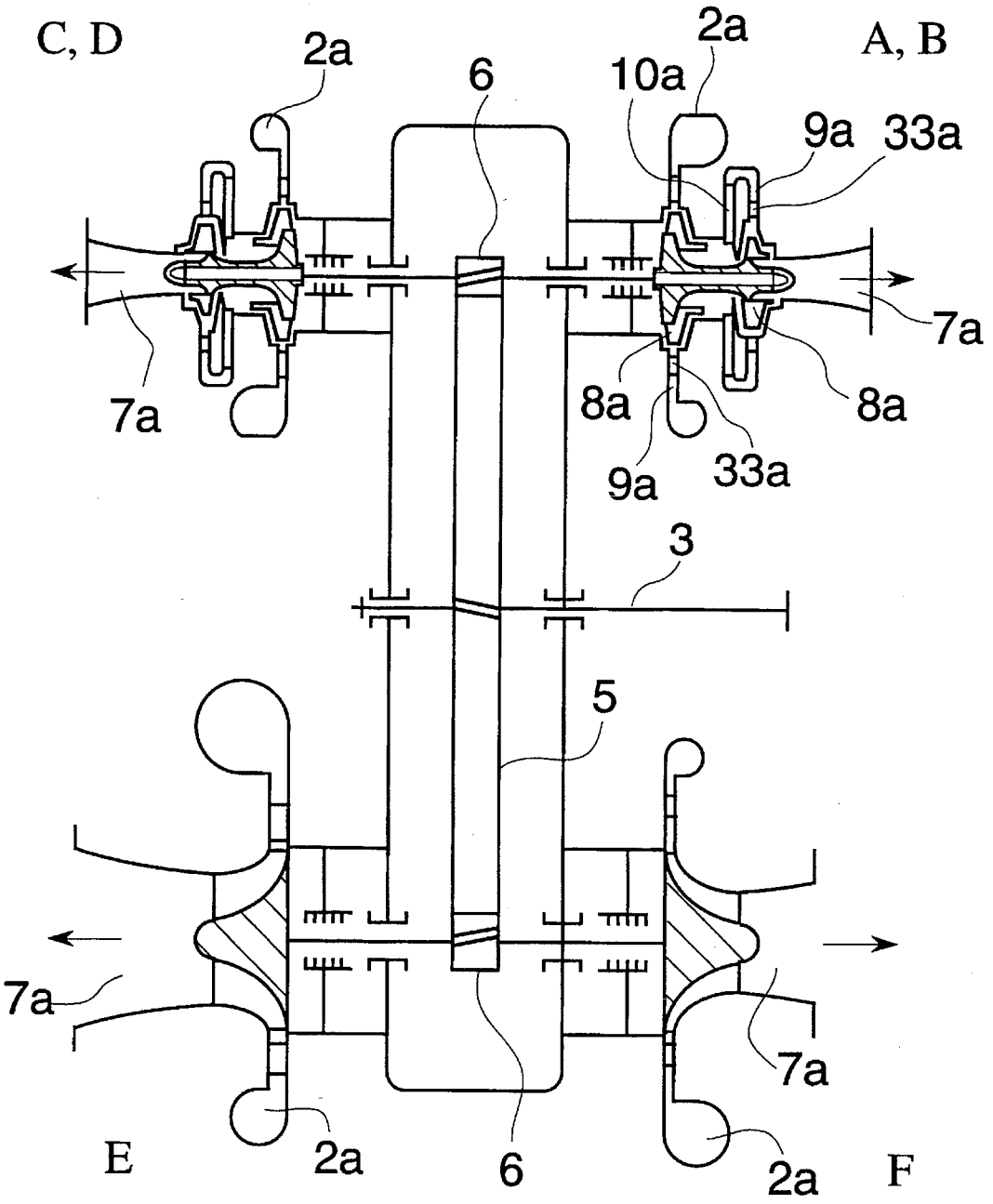
FIG. 20 is a sectional view based on a line XX—XX through the lower horizontal parting line of a radial expander according to the present invention with a pinion shaft with the high-pressure stages A through D and with a pinion shaft with conventional low-pressure stages E and F.

FIG. 20 shows the schematic design of a radial expander according to the present invention through the lower horizontal parting line.

The radial expander is equipped with a the high-pressure shaft 6 according to the present invention with the high-pressure stages A through D and with a the conventional low-pressure shaft 6 with the stages E and F. Two the expander impellers 8*a* are arranged on the high-pressure shaft 6 on the pinion shaft end 6 in the same direction of flow.

The gas enters the impeller 8*a* from the intake housing 2*a* designed as a spiral housing and from the guide blade 33a arranged in the disk annular space 9*a*, and it subsequently enters, via the return ring 10*a*, the second stage, and from there the discharge cone diffuser 7*a* of the radial expander.

Figure 21:
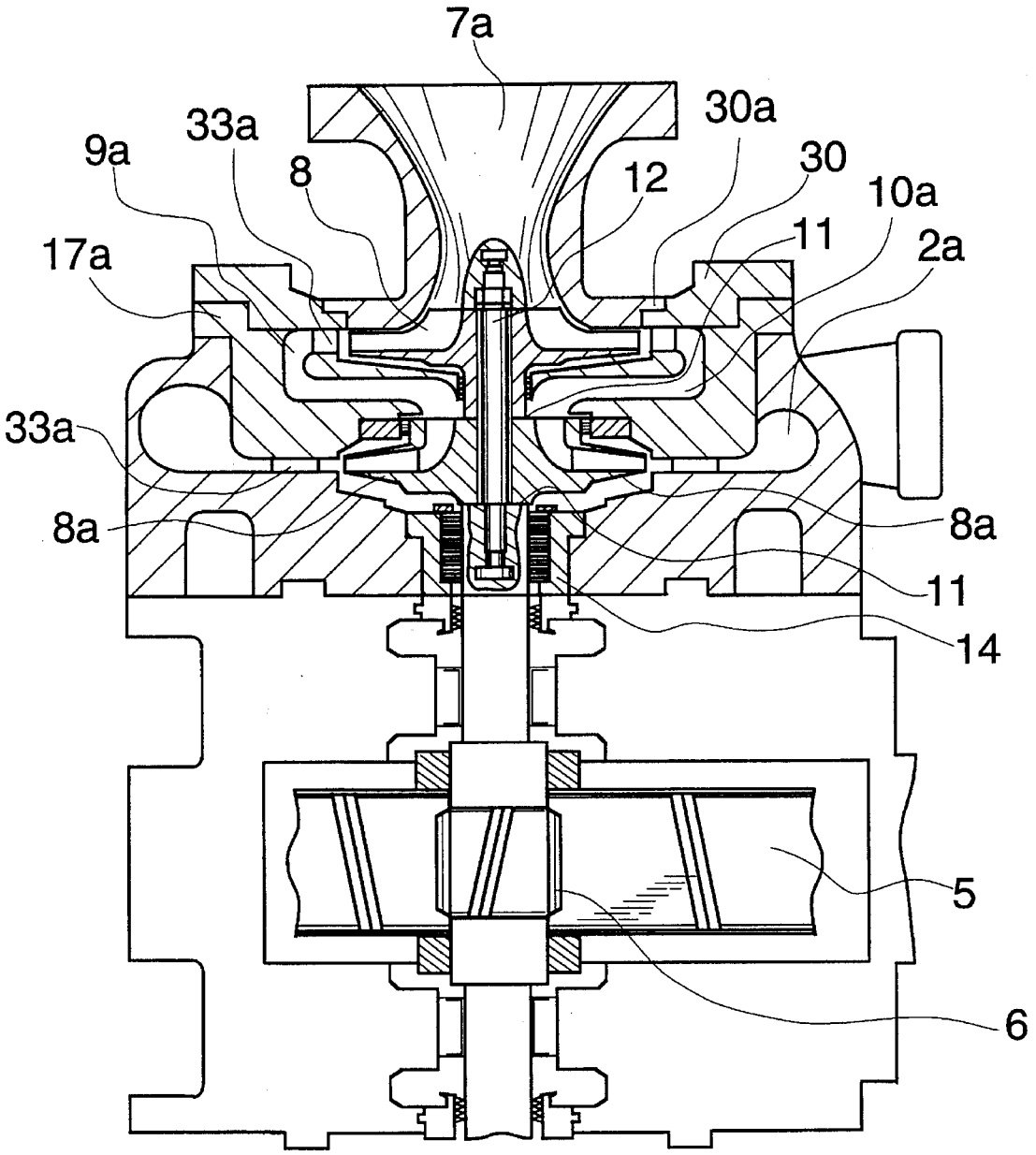
FIG. 21 is a horizontal sectional view through a pinion shaft end of a radial expander.

FIG. 21 shows, in a horizontal section, a the pinion shaft end 6 of a radial expander with an undivided inner housing 17*a*. Inlet guide wheels 33*a* are arranged in the disk annular space 9*a* at the inlet of the impellers. The return ring 10*a* is designed as a bladeless return ring here, and is used for deflection and as a radial diffuser after the first impeller 8*a*.

Figure 22:
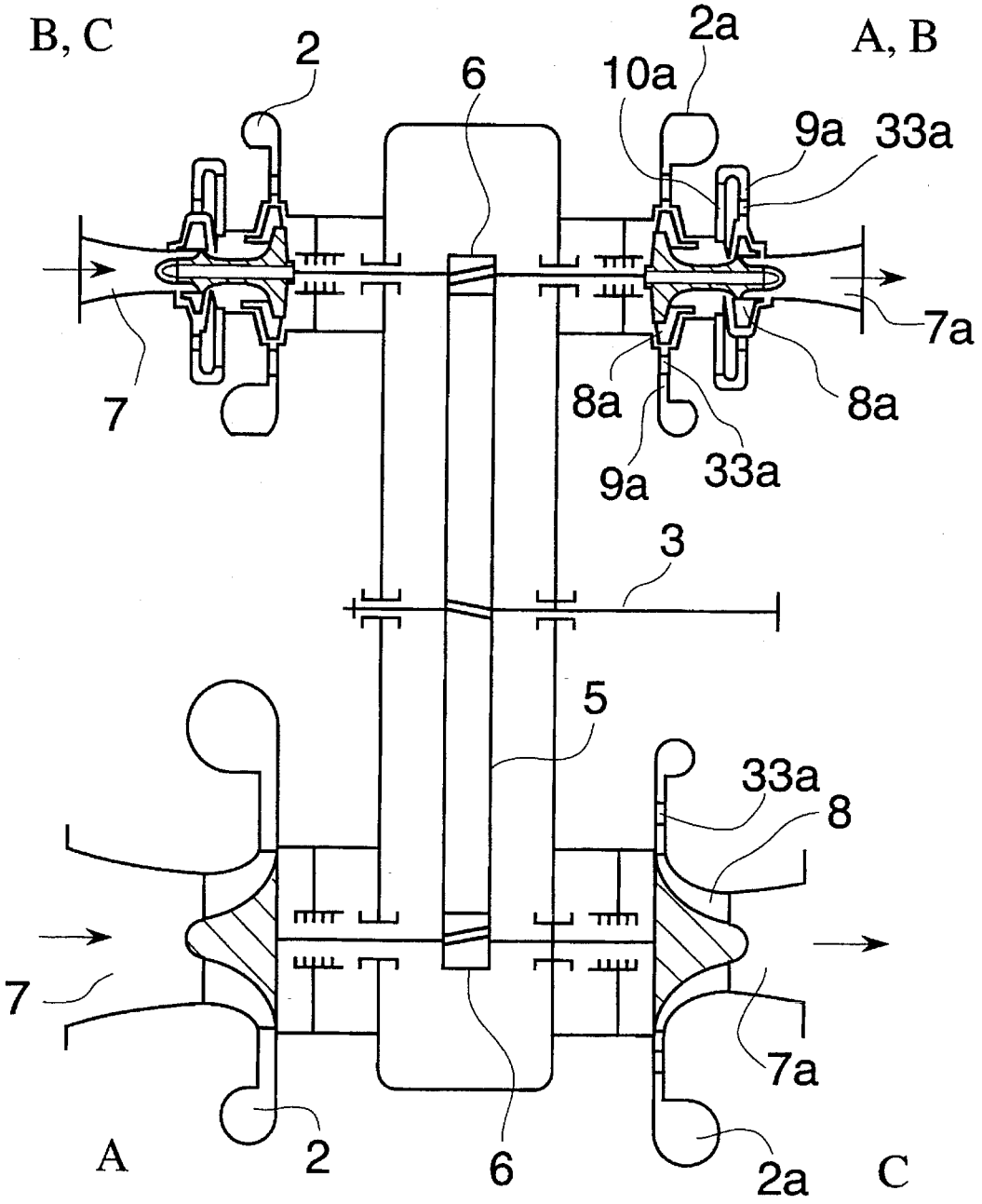
FIG. 22 is a sectional view based on a line XXII—XXII through the horizontal parting line of geared multishaft turbo engine with a pinion shaft with the high-pressure stages B and B of a turbocompressor, as well as with the high-pressure stages A and B of a radial expander and with a pinion shaft with the low-pressure stage A of the turbocompressor and C of the radial expander.

FIG. 22 shows the combination of a geared multishaft turbo engine with a turbocompressor according to the present invention left-hand side of the figure with a radial expander (right-hand side of the figure), in which the turbocompressor compresses a medium different from that which is expanded in the radial expander. The different volume flow rates are low in the high-pressure range of compression of the turbocompressor (stage group B and C) as well as during the expansion in the radial expander (stage group A and B), and permit the speed of the pinion shafts to be equal. The cost of construction of the combined geared multishaft turbo engine is reduced, and the axial thrusts are extensively compensated due to arrangement on a common pinion shaft 6.

The volume flow rates are of the stone order of magnitude in the low-pressure pressure range of compression of the compressor (stage A) and of expansion of the radial expander (stage C), as a result of which the arrangement of the stages in question on a the common pinion shaft 6 offers advantages here as well.

While specific embodiments of the invention have been shown and described in detail to illustrate the application of the principles of the invention, it will be understood that the invention may be embodied otherwise without departing from such principles.

What is claimed is:

1. A multistage geared multishaft turbocompressor, comprising:

a first pinion shaft:

a first low pressure stage including a volute housing with a first stage individual blade wheel, said first stage individual blade wheel being connected to one end of said first pinion shaft;

a second low pressure stage, including a volute housing and a second stage individual blade wheel, said second stage individual blade wheel being connected to another end of said first pinion shaft:

an additional pinion shaft extending parallel to said first pinion shaft;

a high pressure stage group including a high pressure stage first blade wheel and a high pressure stage second blonde wheel, said high pressure stage first blade wheel and said high pressure stage second blade wheel being disposed adjacent to each other, arranged one behind the other, at one end of said additional pinion shaft;

a high pressure stage housing including means defining an intake for said first blade wheel of said high pressure stage group and theaters defining an outlet adjacent said first blade wheel of said high pressure stage group, a disk diffuser connected to said first blade wheel outlet, a return ring connecting said disk-shaped diffuser to an inlet adjacent said second blade wheel of said high pressure stage group and a volute housing portion surrounding said second blade wheel of said high pressure stage group;

drive means for driving in rotation each of said first pinion shaft and said additional pinion shaft, said drive means including a central gear connected to a first pinion disposed on said first pinion shaft and connected to an additional pinion disposed on said additional pinion shaft:

a first bearing set supporting said first pinion shaft to support said first blade wheel of said high pressure stage group and said second bade wheel of said high pressure group in an overhung manner with no additional bearing between said one end of said additional pinion shaft and said first bearing set;

a central gear bearing set Supporting a drive shaft and supporting said central gear; and an additional bearing set supporting said additional pinion shaft to support said first stage individual blade wheel in an overhung manner and to support said second stage individual blade wheel in an overhung manner.

2. A multistage geared multishaft turbo compressor according to claim 1, further comprising a transmission housing, said central gear being disposed in said transmission housing, said transmission housing supporting said first bearing set, said central gear bearing set and said additional bearing set, said high pressure stage housing being flangedly connected to said transmission housing.

3. A multistage geared multishaft turbo compressor according to claim 1, further comprising a radial expander, wherein at least one of said high pressure stage and said low pressure stage of the turbo compressor compresses a medium different from that which is expanded in said radial expander.

4. A multistage geared multishaft turbo compressor, comprising:

a central transmission housing, including a central gear bearing set, a first bearing set and an additional bearing set;

drive means including a central gear supported by said central gear bearing set and a drive for driving said central gear;

a first pinion shaft with a pinion engaged with said central gear, said first pinion shaft being supported by said first bearing set, said first pinion shaft extending out of said transmission housing on each side of said transmission housing to provide a first pinion shaft end at one side of said transmission housing and a second pinion shaft end at another side of said transmission housing, said first pinion shaft being unsupported between said first end of said first pinion shaft and said first bearing set and said first pinion shaft being unsupported between said second end of said first pinion shaft and said bearing set to provide an overhung first pinion shaft first end and to provide an overhung first pinion shaft second end;

a first low pressure stage including a volute housing with an axially extending intake at an end of said first pinion shaft, a first stage individual impeller, said first stage individual impeller being connected to one end of said first pinion shaft;

a second low pressure stage including a volute housing and a second stage individual impeller, said second stage individual impeller being connected to another end of said first pinion shaft;

an additional pinion shaft extending parallel to said first pinion shaft with a pinion engaged with said central gear, said additional pinion shaft being supported by said additional bearing set, said additional pinion shaft extending out of said transmission housing on each side of said transmission housing to provide a first additional pinion shaft end at one side of said transmission housing and a second additional pinion shaft end at another side of said transmission housing, said additional pinion shaft being unsupported between said first end of said additional pinion shaft and said first bearing set and said additional pinion shaft being unsupported between said second end of said additional pinion shaft and said bearing set to provide an overhung additional pinion shaft first end and to provide an overhung additional pinion shaft second end;

a high pressure stage group including a high pressure stage first impeller and a high pressure stage second impeller, said high pressure stage first impeller and said high pressure stage second impeller being disposed adjacent to each other, arranged one behind the other, at said first additional pinion shaft end;

a high pressure stage housing including means defining an axial intake for said high pressure stage first impeller and means defining an outlet adjacent said high pressure stage first impeller, a disk diffuser connected to said outlet and a return ring connecting said disk-shaped diffuser to an inlet adjacent said high pressure stage impeller, said high pressure stage housing having no bearings for supporting said first impeller and said second impeller, said high pressure stage housing being flangedly connected to said transmission housing, said high pressure stage housing defining a direction of flow from said one end of said additional pinion shaft toward said transmission housing.

5. A multistage geared multishaft turbocompressor according to claim 4, wherein said high pressure stage housing includes a volute housing portion surrounding said high pressure stage group second impeller.

6. Multistage geared multishaft turbocompressor in accordance with claim 4 wherein only a dummy piston is arranged on said second additional pinion shaft end.

7. Multistage geared multishaft turbocompressor in accordance with claim 4, further comprising:

connection pieces for feeding in or extracting gases to increase or decrease gas flow being delivered, said connection pieces being arranged at said return ring or at said return ring and at an additional return ring.

8. Multistage geared multishaft turbocompressor in accordance with claim 4, wherein said impellers of said high-pressure stage, are connected to one another by radial serrations and central pins.

9. Multistage geared multishaft turbocompressor in accordance with claim 4, wherein an inner barrel with a horizontal splitting line forming a horizontally split inner barrel, said inner barrel supporting a rotor with impellers and a horizontally not split outer casing surrounds said inner barrel:

a gearbox case cooperates with said split inner barrel to form an additional casing chamber;

and a relief line connected to said additional casing chamber.

10. Multistage geared multishaft turbocompressor in accordance with claim 4, wherein said impellers of one stage group are designed with a cover disk.

11. Multistage geared multishaft turbocompressor in accordance with claim 4, whereon said impellers include an impeller of a first stage of a stage group designed without a cover disk.

12. Multistage geared multishaft turbocompressor in accordance with claim 4, wherein said impellers include an impeller of a first stage of a stage group having a smaller outer diameter than that of a stage connected via said return ring.

13. Multistage geared multishaft turbocompressor in accordance with claim 4, wherein said impellers include one or more impellers of one stage group made of a material of a density lower than that of steel.

14. Multistage geared multishaft turbocompressor in accordance with claim 4, wherein one or more pinion shafts associated with said high-pressure stages are mounted in magnetic bearings.

15. Multistage geared multishaft turbocompressor in accordance with claim 4, wherein one or more pinion shafts are mounted in radial magnetic bearings and the corresponding pinion shafts and the central gear are provided with axial pressure cogs.

16. Multistage geared multishaft turbocompressor in accordance with claim 4, wherein said impellers include two or more impellers of one pressure group attached to the pinion shaft end with common radial serrations.

17. Multistage geared multishaft turbocompressor in accordance with claim 16, wherein common radial serrations are arranged in an area of a center of gravity of said impellers.

18. Multistage geared multishaft turbocompressor in accordance with claim 4, further comprising casing or diaphragm walls defining impeller chambers, said walls being provided with radial whirl-breaking grooves.

19. Multistage geared multishaft turbocompressor in accordance with claim 4, further comprising labyrinth glands having a central area and a leak flow inlet side with edge zones;

sealing gas feed lines opening into said central area of the labyrinths;

and whirl-breaking ribs arranged at right angles to a circumferential direction in said edge zones of the leak flow inlet side of said labyrinth glands.

20. Multistage geared multishaft turbocompressor in accordance with claim 4, further comprising adjustable inlet guide vanes arranged in front of a first stage of a stage group, and an adjustable diffuser guide vanes arranged at a last stage of said stage group.

21. Multistage geared multishaft turbocompressor in accordance with claim 4, wherein the direction of flow is reversed by admitting gas on the high-pressure side and discharging the gas on the low-pressure side to form a radial expander.

* * * * *

UNITED STATES PATENT AND TRADEMARK OFFICE

CERTIFICATE OF CORRECTION

PATENT NO. : 5,490,760
DATED : February 13, 1996
INVENTOR(S) : Joachim Kotzur

It is certified that error appears in the above-indentified patent and that said Letters Patent is hereby corrected as shown below:

Title page, item [54] and col. 1, correct the title to read as follows:

MULTISTAGE GEARED MULTISHAFT TURBOCOMPRESSOR WITH RETURN CHANNEL STAGES AND RADIAL EXPANDER.

Title page, item [73], Assignee: should read-- MAN GUTEHOFFNUNGSHUTTE AG, OBERHAUSEN, Germany.

Signed and Sealed this

Fourth Day of June, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,490,760
DATED : February 13, 1996
INVENTOR(S) : Joachim KOTZUR

It is certified that error appears in the above-indentified patent and that said Letters Patent is hereby corrected as shown below:

Please correct claim 1 as follows:

column 11, line 39 replace "theaters" with -- means --.

column 11, line 54 replace "a first" with -- an additional --
and replace "first pinion" with -- additional pinion --.

column 11, line 56 replace "bade" with -- blade --.

column 11, line 59 replace "first" with -- additional --.

UNITED STATES PATENT AND TRADEMARK OFFICE

CERTIFICATE OF CORRECTION

PATENT NO. : 5,490,760

DATED : February 13, 1996

INVENTOR(S) : Joachim KOTZUR

It is certified that error appears in the above-indentified patent and that said Letters Patent is hereby corrected as shown below:

column 11, line 62 replace "an additional" with -- a first --
and replace "additional pinion" with -- first pinion --.

Signed and Sealed this

Sixth Day of August, 1996

*Attest:*

*Attesting Officer*

BRUCE LEHMAN

*Commissioner of Patents and Trademarks*